US006666948B2

(12) United States Patent
Nguyen

(10) Patent No.: US 6,666,948 B2
(45) **Date of Patent: *Dec. 23, 2003**

(54) SILICON WAFER POLISHER

(76) Inventor: Phuong Van Nguyen, 2903 Erica Ct., San Jose, CA (US) 95121

( * ) Notice: Subject to any disclaimer, the term of this patent is extended or adjusted under 35 U.S.C. 154(b) by 234 days.

This patent is subject to a terminal disclaimer.

(21) Appl. No.: 09/908,013

(22) Filed: Jul. 18, 2001

(65) Prior Publication Data

US 2002/0155718 A1 Oct. 24, 2002

Related U.S. Application Data

(63) Continuation-in-part of application No. 09/840,506, filed on Apr. 23, 2001.

(51) Int. Cl.[7] ..... B24B 1/00

(52) U.S. Cl. ..... 156/345.12; 156/345.22; 451/66; 134/113; 216/38

(58) Field of Search ..... 156/345.22, 345.12; 451/66; 134/113

(56) References Cited

U.S. PATENT DOCUMENTS

2002/0155791 A1 * 10/2002 Nguyen ..... 451/36

2002/0155793 A1 * 10/2002 Nguyen ..... 451/41

* cited by examiner

*Primary Examiner*—Gregory Mills
*Assistant Examiner*—Sylvia R. MacArthur
(74) *Attorney, Agent, or Firm*—Michael I Kroll

(57) ABSTRACT

An method and apparatus for forming wafers of varying thickness'. The apparatus includes a template. The template is formed of a main disk including a plurality of cavities extending into a first side thereof and a backing plate positioned on a side of the main disk opposite the first side. Holding disks are moistened and positioned within respective cavities for releasably securing a wafer in the cavity. When the template is releasably secured to and rotatable with a rotating head and positioned such that the first side faces a lapping and polishing surface, wafers received by the cavities are lapped and polished upon rotation of the rotating head. A plurality of shims are selectively received within respective cavities between a base of the cavity and the holding disk for adjusting a depth of the cavity thereby adjusting an amount of a wafer to be lapped and polished. The shims have varying thickness' and are color coated, each color being representative of a predetermined thickness for the shim. A mylar layer is bonded to a side of the backing plate opposite the main disk. A liquid is provided atop the lapping and polishing surface upon rotation of the templates.

39 Claims, 21 Drawing Sheets

SILICON WAFER POLISHER

REFERENCE TO RELATED APPLICATIONS

This application is a continuation in part application of U.S. patent application Ser. No. 09/840,506 filed on Apr. 23, 2001.

BACKGROUND OF THE INVENTION

1. Field of the Invention

The present invention relates generally to devices for polishing workpieces and, more specifically, to a device for polishing silicon wafers including a planar template having a plurality of cavities wherein a silicon wafer is placed within a respective cavity for polishing to a thickness equivalent to the depth of the template cavity.

2. Description of the Prior Art

The prior art discloses numerous templates for lapping and polishing wafers to a desirable thickness determined by the depth of the template cavity. However, the prior art devices and methods each contain one or more undesirable characteristics that render them unsuitable for repeated use.

A prior art process of lapping and polishing blank wafers includes placing the workpieces into a template and placing the template upside down between a rotating pneumatic head and a table. A controlled flow of abrasive slurry flows onto the table surface during rotation of the pneumatic head whereby the wafer blanks are honed and polished to the thickness of the template.

There are two undesirable side effects that can occur with this method. As the wafers approach the thickness of the template cavity, the amount of fluid between the template and table decreases causing spotted changes in the surface temperature of the template and thereby burnishing the template. In addition, the cross sectional thickness of the finished wafer is affected. The wafers rotate within the cavity causing the wafers to continuously butt up against the wall of the cavity and rise from the cavity base. This potentially causes the edge thickness of the wafer to vary from the center thickness, especially in applications where tolerances are measured in the +/− tens of picometers.

It is thus desirable to provide a method and apparatus for polishing a wafer which overcomes both of the above discussed shortcomings with the prior art. It is further desirable to provide a method and apparatus for polishing a wafer which is able to increase the efficiency of present methods by reducing the number of templates used. It is even further desirable to provide a method and apparatus for polishing a wafer which is able to account for the varied thickness' required within the end product.

Therefore because of the aforementioned problem it is felt that a need exists for the present invention and while the prior art may be suitable for the purposes for which they were designed, they would not be as suitable for the purposes of the present invention, as hereinafter described.

SUMMARY OF THE PRESENT INVENTION

The present invention relates generally to devices for polishing workpieces and, more specifically, to a device for polishing silicon wafers including a planar template having a plurality of cavities wherein a silicon wafer is placed for polishing to a thickness equivalent to the depth of the template cavity.

A primary object of the present invention is to provide a method and apparatus for lapping and polishing silicon wafers that will overcome the shortcomings of prior art devices.

Another object of the present invention is to provide a method and apparatus for lapping and polishing silicon wafers that can be used repeatedly.

Yet another object of the present invention is to provide a method and apparatus for lapping and polishing silicon wafers wherein the apparatus includes templates substantially comprised of fiberglass-epoxy laminates.

Still yet another object of the present invention is to provide a method and apparatus for lapping and polishing silicon wafers wherein the templates have a backing material adhesively affixed thereto.

Another object of the present invention is to provide a method and apparatus for lapping and polishing silicon wafers wherein the templates include a backing adhesively affixed thereto formed from mylar or other suitable frictionless material.

Still yet another object of the present invention is to provide a method and apparatus for lapping and polishing silicon wafers having a plurality of shims preferably manufactured from a suitable material such as polyurethane.

Yet another object of the present invention is to provide a method and apparatus for lapping and polishing silicon wafers wherein the shim is affixed to the base of the plurality of cavities within said template thereby adjusting the depth of the cavity.

Still yet another object of the present invention is to provide a method and apparatus for lapping and polishing silicon wafers wherein the affixed shim is of smaller diameter than the diameter of the plurality of workpiece cavities within the template and the periphery of the wafer contained within the workpiece cavity extends beyond the circumference of the shim.

Yet another object of the present invention is to provide a method and apparatus for lapping and polishing silicon wafers able to reduce tapering of the wafer.

Another object of the present invention is to provide a method and apparatus for lapping and polishing silicon wafers wherein the plurality of shims are of various thickness' that can be removably inserted into each of the plurality of cavities within the template.

Yet another object of the present invention is to provide a method and apparatus for lapping and polishing silicon wafers wherein the template can be used to produce wafers of various and/or calculated thickness'.

Additional objects of the present invention will appear as the description proceeds.

A method and apparatus for forming wafers of varying thickness' is disclosed by the present invention. The apparatus includes a template. The template is formed of a main disk including a plurality of cavities extending into a first side thereof and a backing plate positioned on a side of the main disk opposite the first side. Holding disks are moistened and positioned within respective cavities for releasably securing a wafer in the cavity. When the template is releasably secured to and rotatable with a rotating head and positioned such that the first side faces a lapping and polishing surface, wafers received by the cavities are lapped and polished upon rotation of the rotating head. A plurality of shims are selectively received within respective cavities between a base of the cavity and the holding disk for adjusting a depth of the cavity thereby adjusting an amount of a wafer to be lapped and polished. The shims have varying thickness' and are color coated, each color being representative of a predetermined thickness for the shim. A mylar layer is bonded to a side of the backing plate opposite the main disk. A liquid is provided atop the lapping and polishing surface upon rotation of the templates.

The present invention overcomes the shortcomings of the prior art by providing a method and device whereby employing the reusable workpiece template and selectively inserting shims of various thickness' produce semiconductor wafers of varying thickness'.

In addition, the workpiece template having a shim centrally affixed and positioned within the base of the workpiece cavities reduce tapering of the wafer. Furthermore, having a suitable frictionless material, such as mylar, induce rotation of the wafer thereby reducing tapering.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
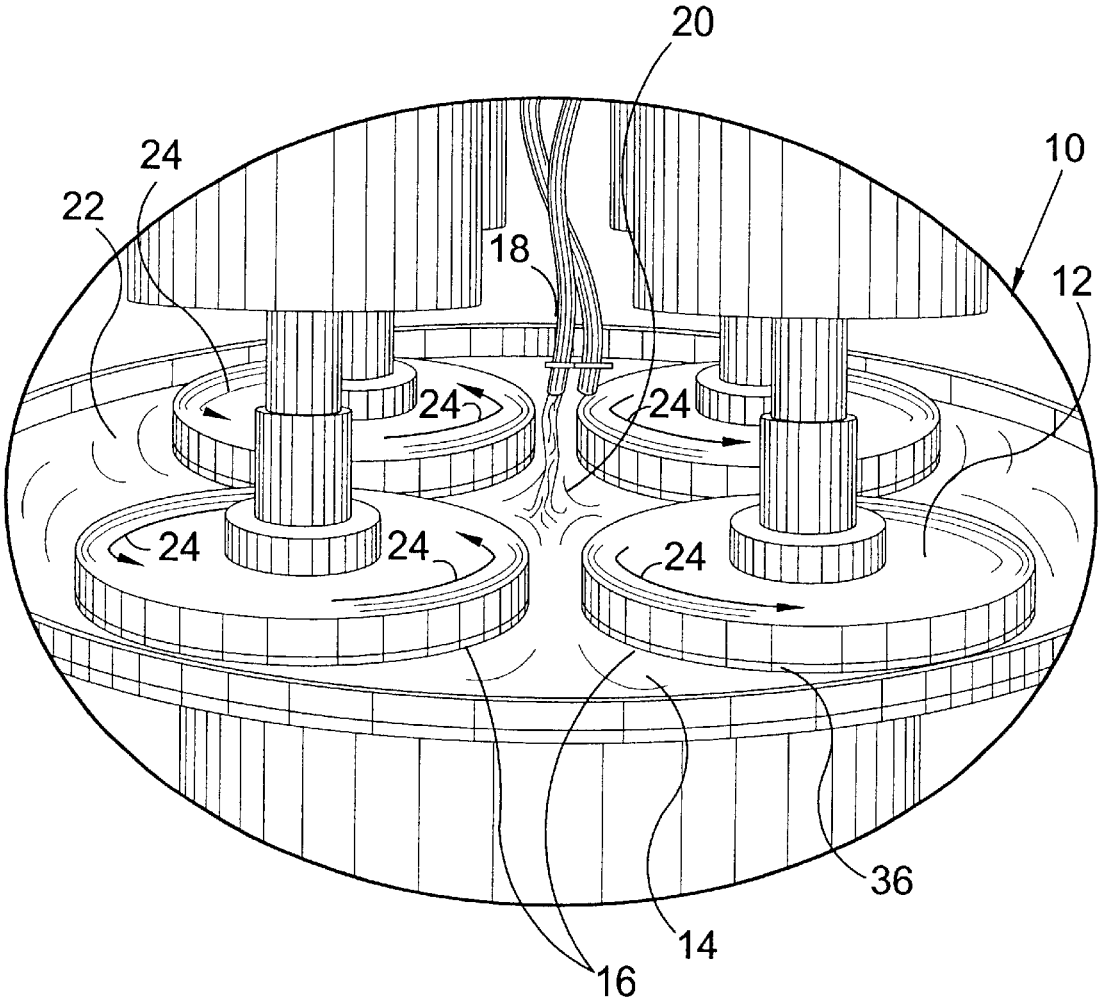
FIG. 1 is a perspective view of the silicon wafer polishing holder of the present invention.

Turning now descriptively to the drawings, in which similar reference characters denote similar elements throughout the several views, the Figures illustrate the silicon wafer polishing holder of the present invention. With regard to the reference numerals used, the following numbering is used throughout the various drawing figures.

10 silicon wafer polishing holder of the present invention
12 rotating pneumatic heads
14 lapping and polishing surface
16 workpiece template
18 tube
20 supply of moistening liquid
22 top side of lapping and polishing surface
24 arrows indicating rotation of the rotating pneumatic head
26 cavity within workpiece template
28 bottom surface of workpiece template
30 shim
32 top side of the workpiece template
34 backing plate
36 main plate

38 base of cavity
40 mylar layer
42 adhesive layer
44 aperture in main disk
46 adhesive layer
47 top side of holding disk
48 holding disk
49 bottom side of holding disk
50 wafer
51 grooves
52 portion of wafer remaining after lapping and polishing
54 portion of wafer removed by lapping and polishing
56 plurality of grooves extending along the top surface of main plate
58 center of workpiece template
60. Alternate workpiece template
62. Alternate main plate
63. Top Side of main plate
64. Adhesive layer
66. Recessed cavity
68. Base of the recessed cavity
70. Adhesive layer
72. Adhesive layer
73. Recessed cavity
74. Second alternate main plate
76. Grooves
78. Top side of second alternate main plate

DETAILED DESCRIPTION OF THE PREFERRED EMBODIMENT

Turning now descriptively to the drawings, in which similar reference characters denote similar elements throughout the several views, FIGS. 1 through 25 illustrate the silicon wafer polishing holder of the present invention indicated generally by the numeral 10.

The silicon wafer polishing holder 10 of the present invention is shown polishing a wafer in FIG. 1. As can be seen from this view, the silicon wafer polishing holder 10 includes a plurality of rotating pneumatic heads 12. The plurality of rotating pneumatic heads 12 are positioned above a lapping and polishing surface 14. A workpiece template 16 is positioned between the lapping and polishing surface 14 and a respective one of each of the plurality of rotating pneumatic heads 12. The rotating heads rotate as indicated by the arrows labeled with the numeral 24. Each workpiece template 16 includes a main plate 36 having a plurality of cavities extending therein. The cavities extend at least partially through the main plate and possible entirely through the main plate 36. Each cavity is able to receive a silicon wafer, not shown in this figure. Each workpiece template 16 is positioned under and rotated by the respective rotating pneumatic head 12. The workpiece templates 16 place the silicon wafers in communication with the lapping and polishing surface 14 and rotate the silicon wafers generating a frictional force between the silicon wafers and the lapping and polishing surface 14. The frictional force acts to polish the silicon wafers. A tube 18 is positioned above the lapping and polishing surface 14 for providing a supply of moistening liquid 20 to a top side 22 of the lapping and polishing surface and between the lapping and polishing surface 14 and the workpiece template 16. The supply of the moistening liquid 20 reduces the heat produced by the friction between the wafer and the lapping and polishing surface 14 while also aiding in producing a suction force to maintain the position of the wafer within the cavity.

Figure 2:
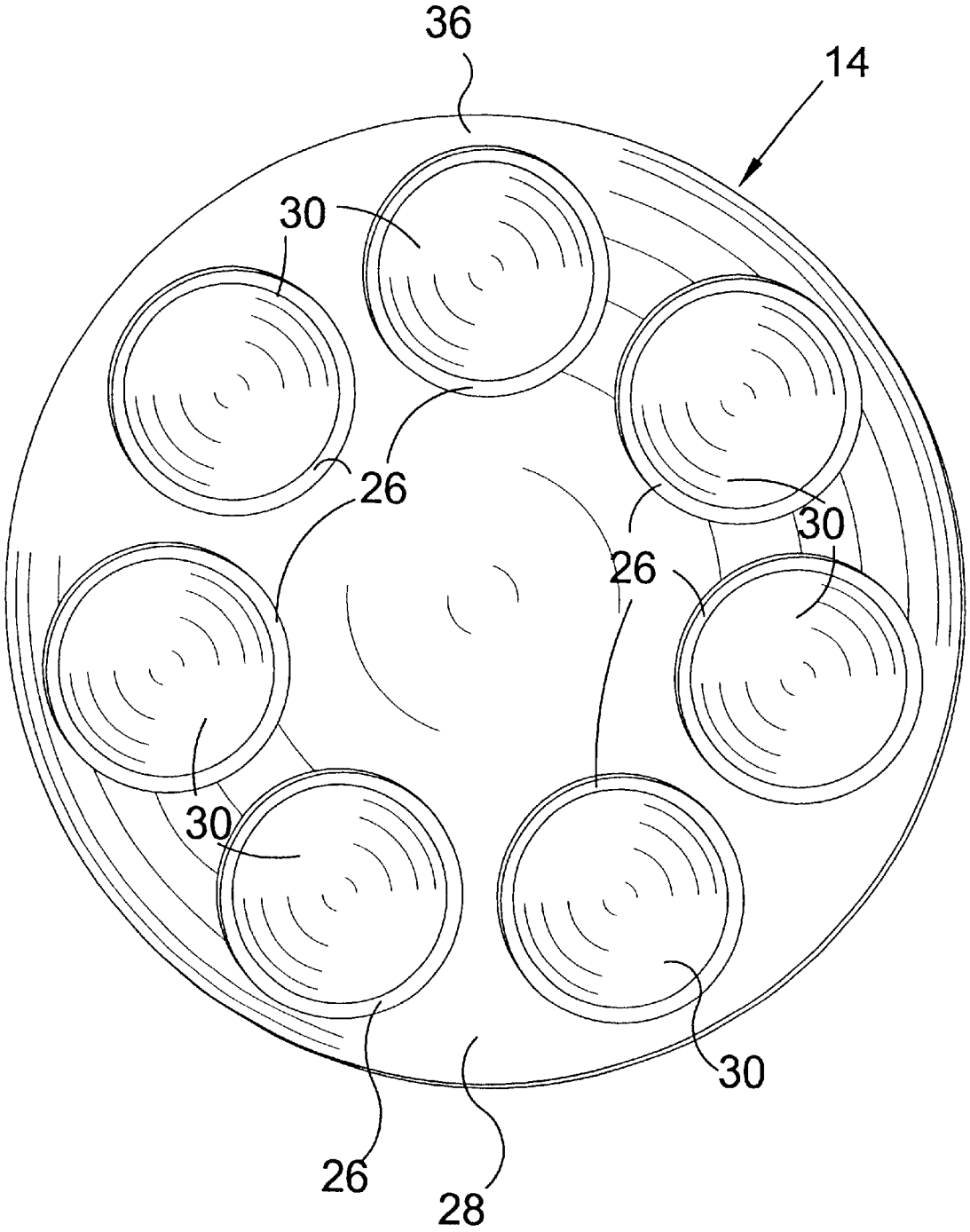
FIG. 2 is a bottom side view of a workpiece template used with the silicon wafer polishing holder of the present invention.

A bottom side view of the workpiece template 14 of the silicon wafer polishing holder 10 of the present invention is shown in FIG. 2. From this view, the workpiece template 14 is shown having a main plate 36 including the plurality of cavities 26 extending into a bottom surface 28 thereof. Positioned within each cavity 26 is a shim 30 having a diameter smaller than the diameter of the workpiece cavity 26. Each shim 30 has a predetermined thickness and insertion of a shim 30 within a cavity 26 adjusts the depth of the cavity 26 in which it is positioned. The adjustment of the depth of the cavity 26 allows a user to determine the amount of lapping and polishing to be performed on a wafer positioned within the cavity 26.

Figure 3:
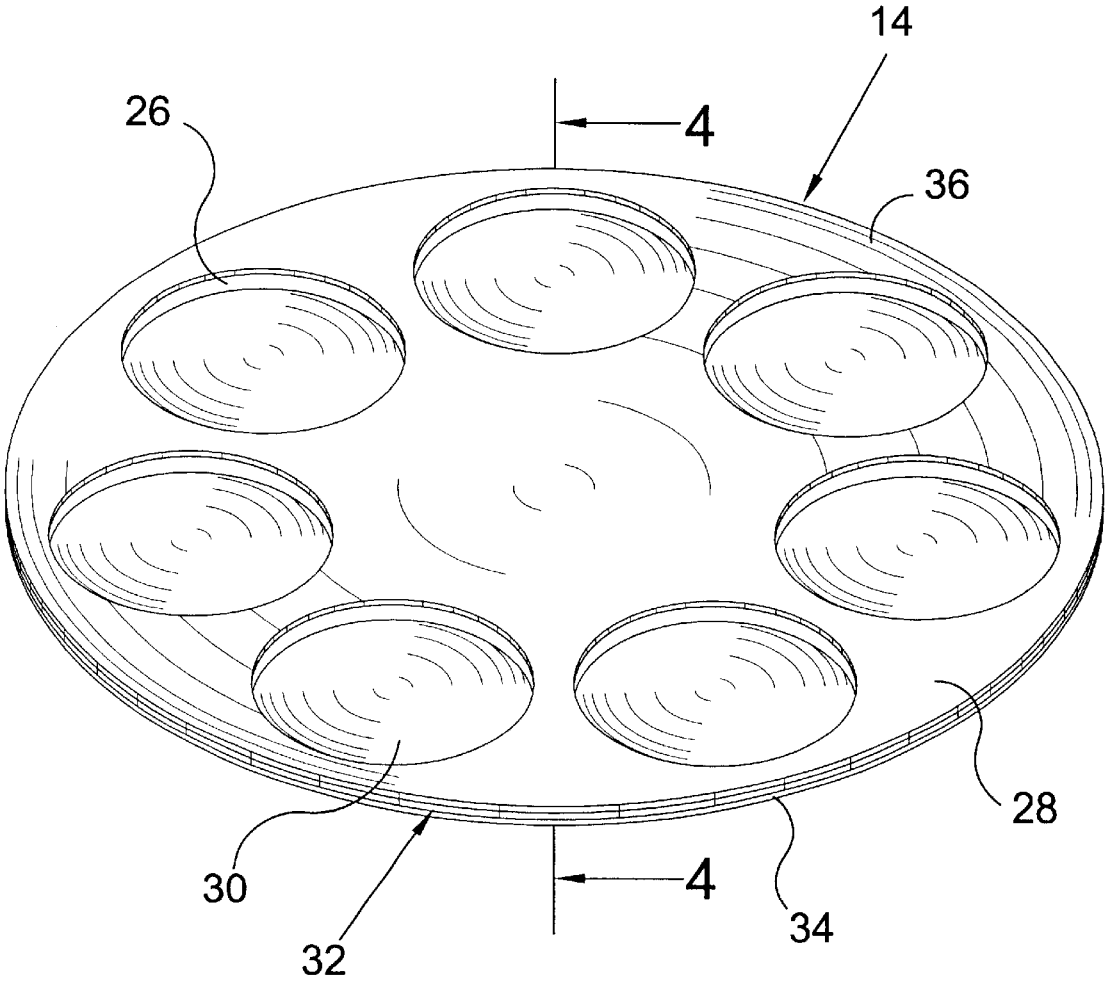
FIG. 3 is a perspective view of the workpiece template of the silicon wafer polishing holder of the present invention.

A perspective bottom side view of the workpiece template 14 is illustrated in FIG. 3. This figure shows the bottom side 28 of the planar main plate 36 including the plurality of cavities 26 extending therein. Positioned on a top side 32 of the main plate 36 opposite the bottom side 28 is a backing plate 34. The main plate 36 is preferably formed of fiberglass-epoxy laminates.

Figure 4:
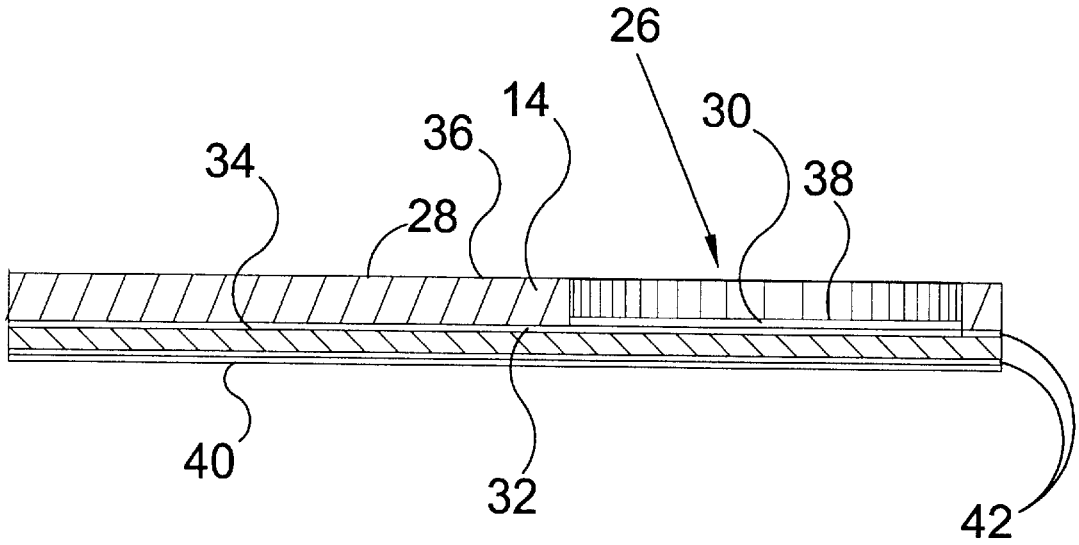
FIG. 4 is a cross sectional view of the workpiece template of the silicon wafer polishing holder of the present invention.

A cross sectional view of the workpiece template 14 is shown in FIG. 4. This figure shows the main plate 36 formed from heat and moisture resistant material such as fiberglass-epoxy laminates. Extending into the bottom side 28 of the main plate 36 and possibly extending through the main plate 36 are the plurality of cavities 26. The cavities 26 extend at least partially and possibly fully through the main plate 36. The backing plate 34 is adhesively bonded to the top side 32 of the main plate 36. The backing plate acts as a base 38 for the cavities 26 should the cavity 26 extend entirely through the main plate 36. On a side of the backing plate 34 opposite the main plate 36 is a mylar layer 40. The mylar layer 40 is adhesively bonded to the backing plate by an adhesive layer 42.

Figure 5:
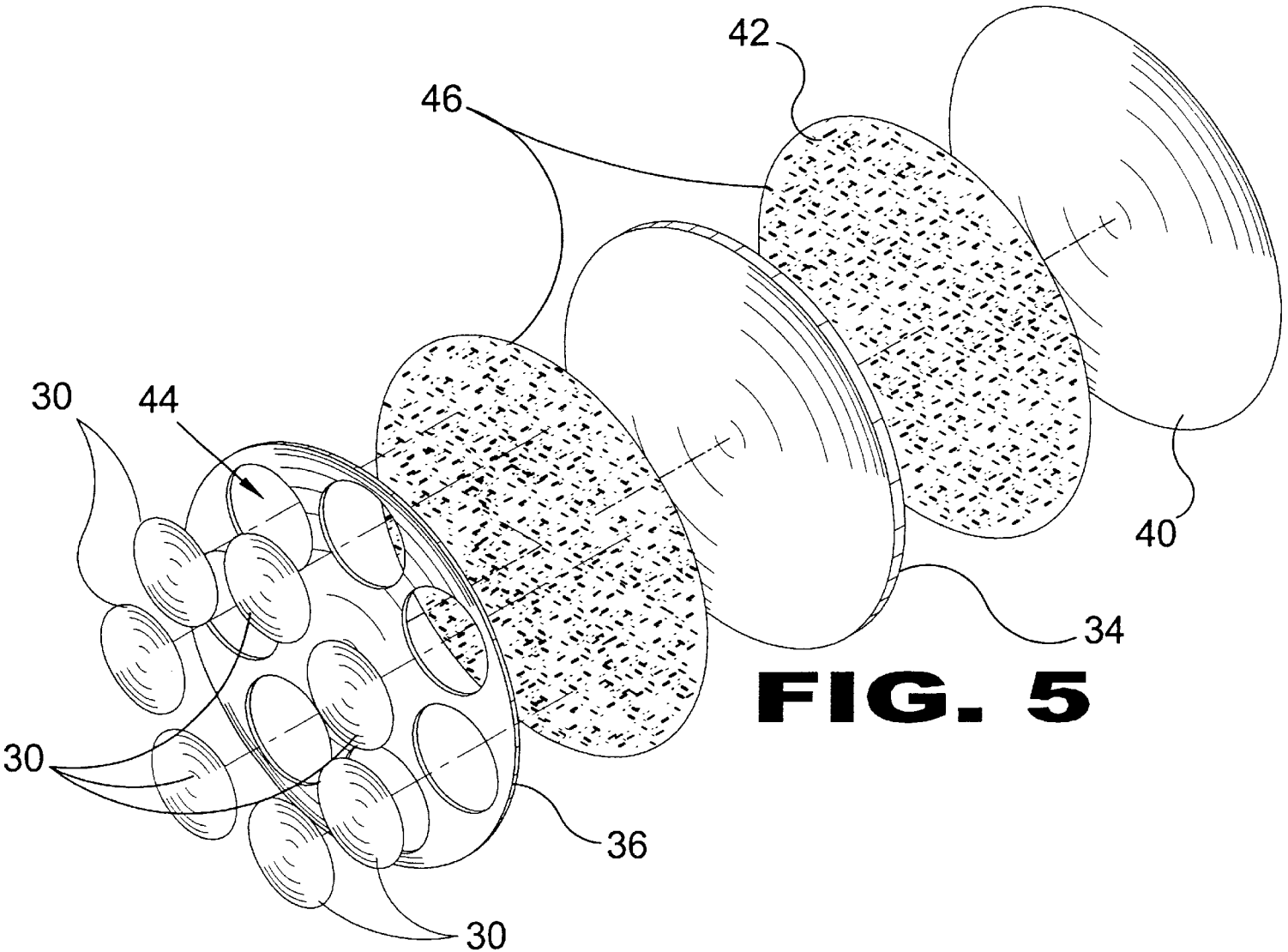
FIG. 5 is an exploded view of the workpiece template of the silicon wafer polishing holder of the present invention.

An exploded view of the workpiece template 14 is illustrated in FIG. 5. As can be seen from this view, the workpiece template 14 includes the main plate 36 having a plurality of apertures 44 extending therethrough. When the backing plate 34 is secured to the top side 32 of the main plate 36, the apertures 44 each form a respective one of the cavities 26 having a depth defined by the base 38. The backing plate 36 is bonded to the main plate 36 by an adhesive layer 46. Bonded to the backing plate 34 on a side opposite the main plate 36 is a mylar layer 40. A second adhesive layer 40 secures the mylar layer 40 to the backing plate 34. A shim 30 having a desired thickness may be adhesively bonded within the apertures 44 of the main plate 36 to adjust the depth of the cavity 26. The shim 30 may be of any desired thickness to adjust the depth of the cavity 26 in which it is positioned. The shims 30 can be of varying thickness' therefore, a shim 30 in one cavity 26 need not be of the same thickness as a shim 30 in any other cavity 26.

Figure 6:
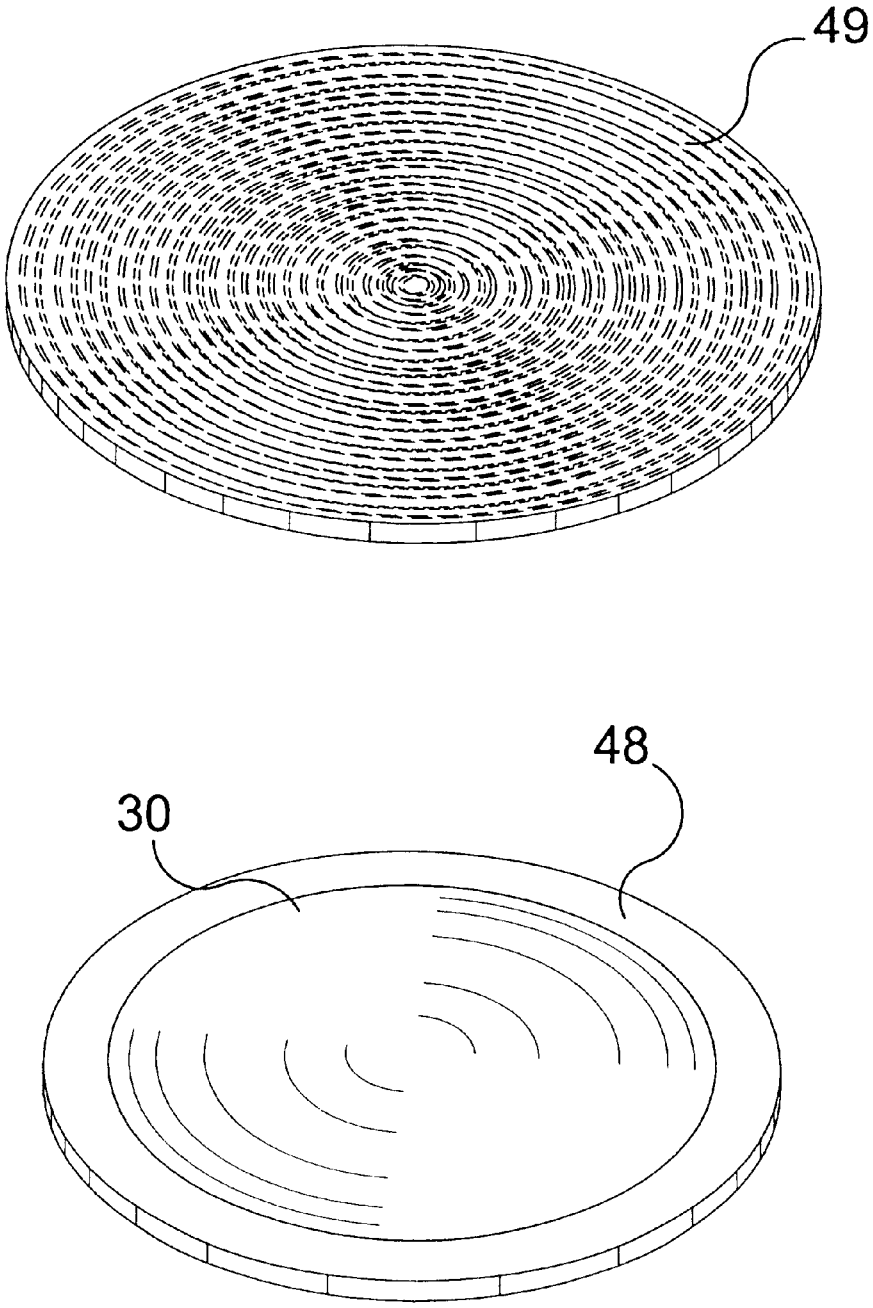
FIG. 6 is a top exploded view of a holding disk of the silicon wafer polishing holder of the present invention.

Within each cavity 26 a holding disk 48 is positioned atop the shim 30. A top side view of a holding disk 48 is shown in FIG. 6. The holding disk 48 is formed from a felt material and acts to hold a wafer within the workpiece template cavity 26. Positioned within the cavity between the holding disk 48 and the base of the cavity 38 is a shim 30 for adjusting the depth of the cavity 26. The shim 30 may be adhesively fixed to the backside of the holding disk 48. Prior to insertion of the wafer the felt material of the holding disk 48 is moistened with a liquid. The liquid is partially forced out when the wafer is placed in the cavity 26 forming a suction bond between the wafer and workpiece template 14.

Figure 7:
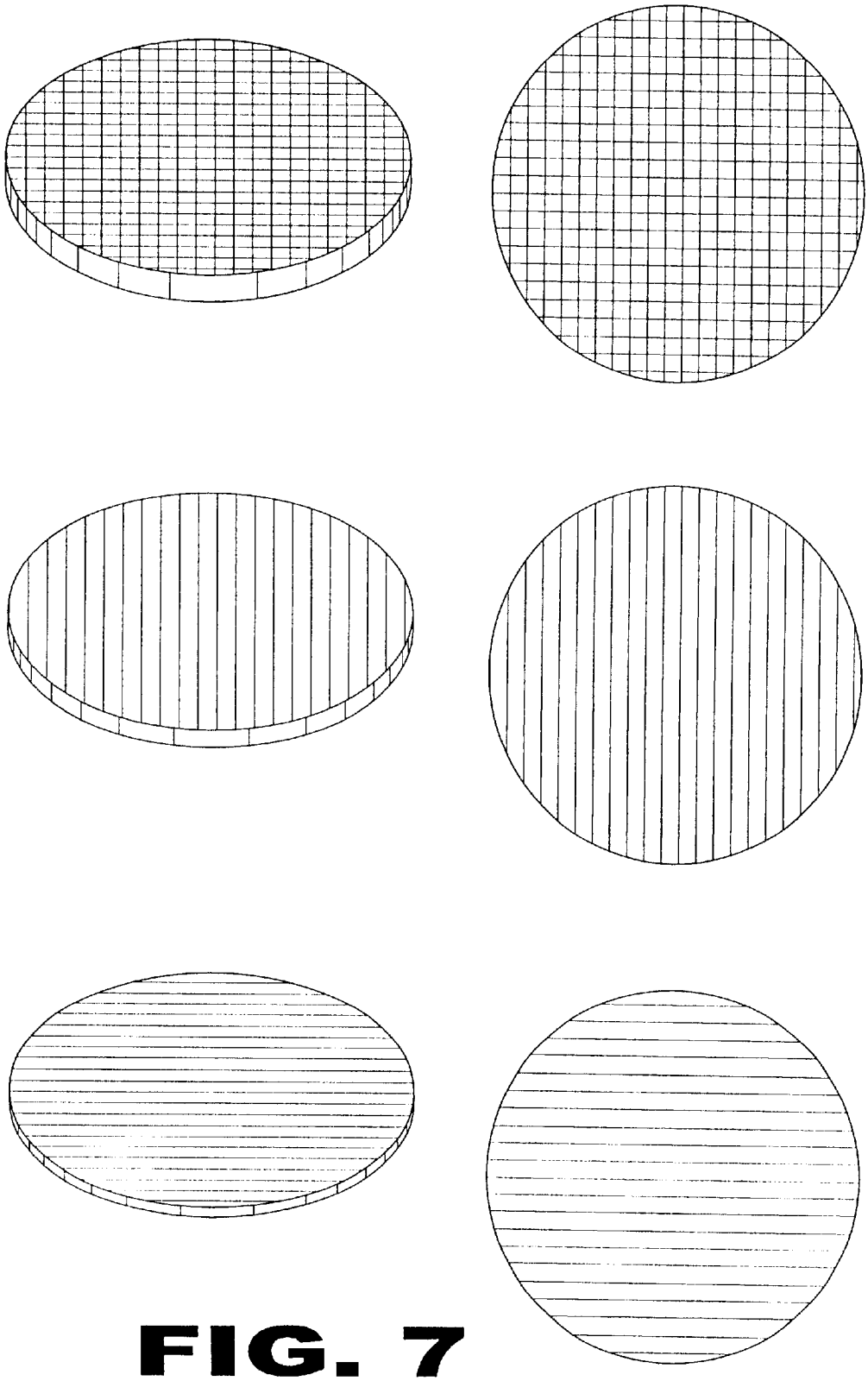
FIG. 7 is a perspective view of a plurality of color-coded shims for use with the silicon wafer polishing holder of the present invention.

A plurality of shim disks 30 are illustrated in FIG. 7. The shim disks 30 are color-coded. Each color is associated with a particular thickness for the shim 30. For each color shim disk 30 a face side view and perspective view is shown in this figure. The perspective view illustrates an exemplary thickness for each color shim disk 30. The differing colors are used to identify a specific thickness for each shim disk 30 and thus be able to accurately adjust the depth of each cavity 26.

Figure 8:
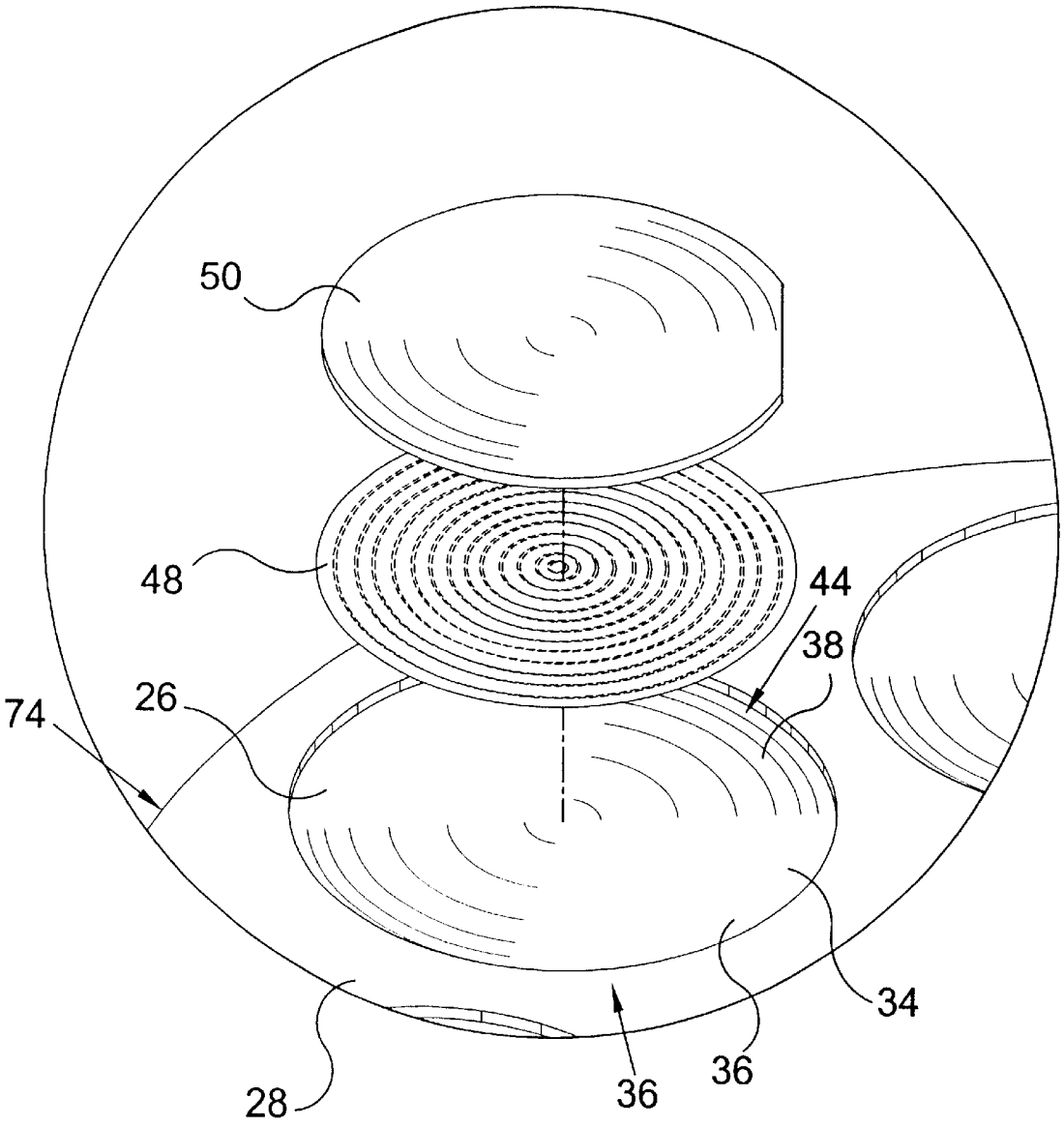
FIG. 8 is an exploded perspective view of the workpiece cavity of the silicon wafer polishing holder of the present invention.
Figure 9:
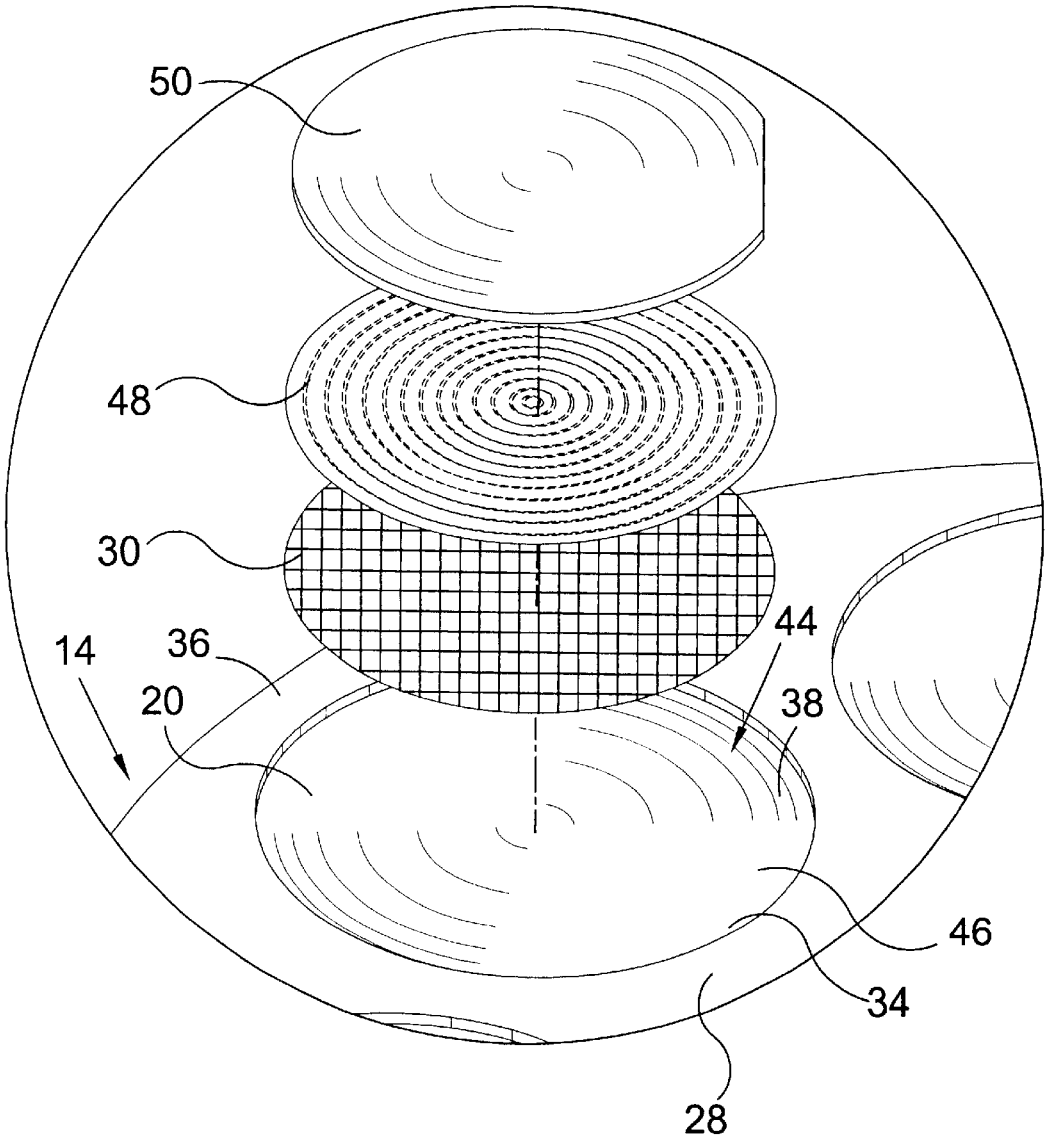
FIG. 9 is an exploded perspective view of a workpiece cavity of the silicon wafer polishing holder of the present invention including a shim positioned therein for adjusting the depth of the cavity.
Figure 10:
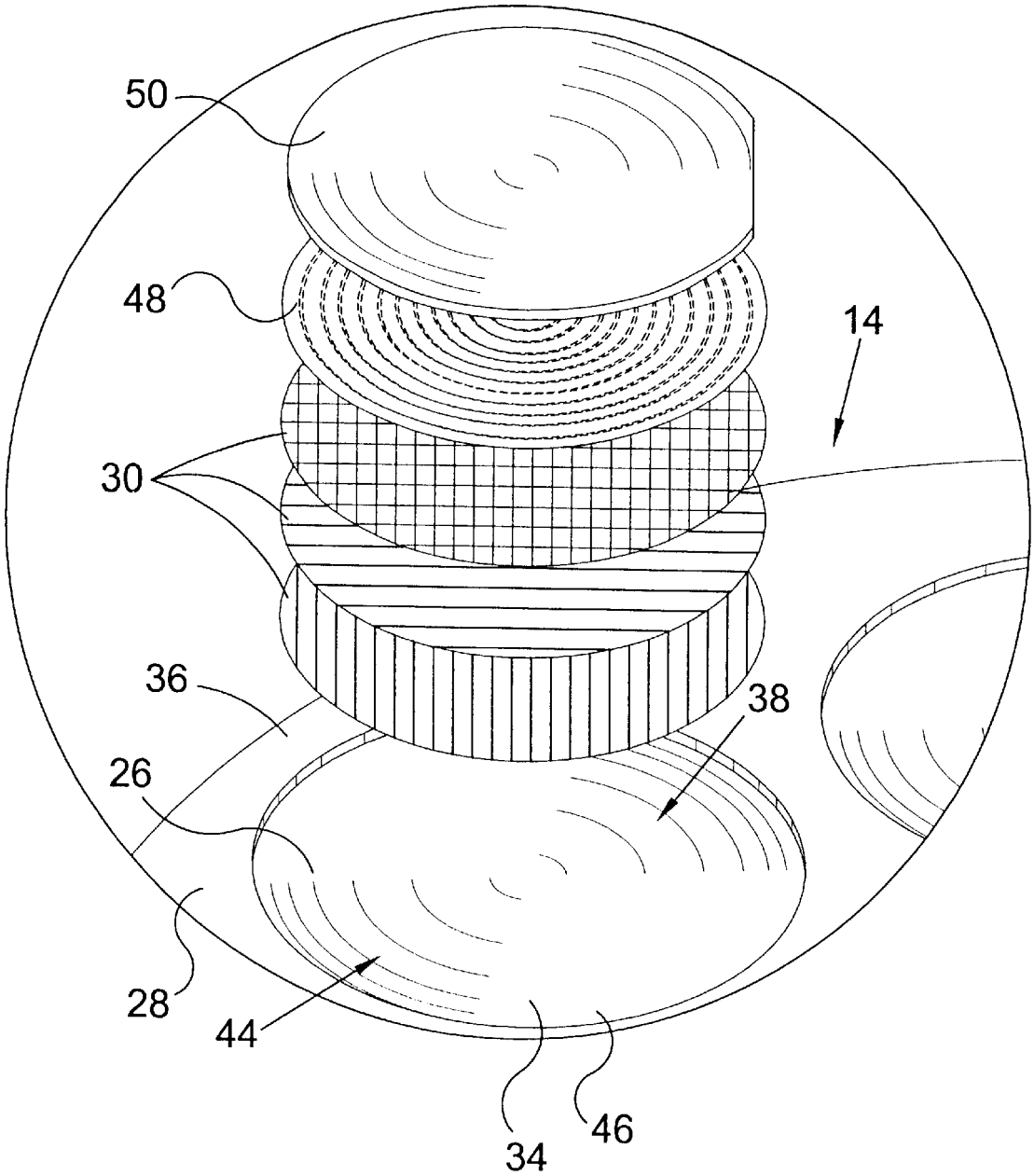
FIG. 10 is an exploded view of the workpiece cavity of the silicon wafer polishing holder of the present invention including a plurality of shims positioned therein for adjusting the depth of the cavity.

FIGS. 8, 9 and 10 each illustrate an exploded perspective view of the elements within a workpiece cavity 26. FIG. 8 illustrates a cavity 26 without a shim disk 30 therein. FIG. 9 illustrates a cavity 26 with a single shim disk 30 therein. FIG. 10 illustrates a cavity 26 with three shim disks 30 therein. As can be seen from these figures, the main disk 36 is positioned atop the backing plate 34 with the adhesive layer 46 positioned therebetween. Positioned within the cavity 26 and atop the base 38 is positioned the holding disk 48. If use of shim disks 30, as is shown in FIGS. 9 and 10, is desired to adjust the depth of the cavity 26, the shim disks 30 are positioned between the base 38 and the holding disk 48. A wafer 50 to be lapped and polished is positioned atop the holding disk 48. The holding disk 48 is moistened and the wafer 50 is placed atop the holding disk 48. Moistening of the holding disk 48 creates a suctional force within the cavity 26. Placement of the wafer 50 atop the moistened holding disk 48 utilizes the suction to maintain the wafer 50 in a stationary position within the cavity 26. The placement of a shim disk 30 within the cavity as shown in FIG. 9 decreases the depth of the cavity 26 thereby raising the height of the wafer within the workpiece cavity 26. This creates a cavity having a smaller depth and thus, upon lapping and polishing produces a thinner wafer 50. The placement of additional shim disks 30 within the cavity 26 as shown in FIG. 10 decreases the depth of the cavity 26 more so than as shown in FIG. 9. This raises the height of the wafer within the workpiece cavity 26 to a greater extent thereby creating a cavity 26 having an even smaller depth. Upon lapping and polishing a wafer 50 within a cavity 26 having a depth as shown in FIG. 10, an even thinner wafer 50 is produced. Using variable amounts of shim disks 30 of differing thickness' allows the creation of a cavity having a desired depth.

Figure 11:
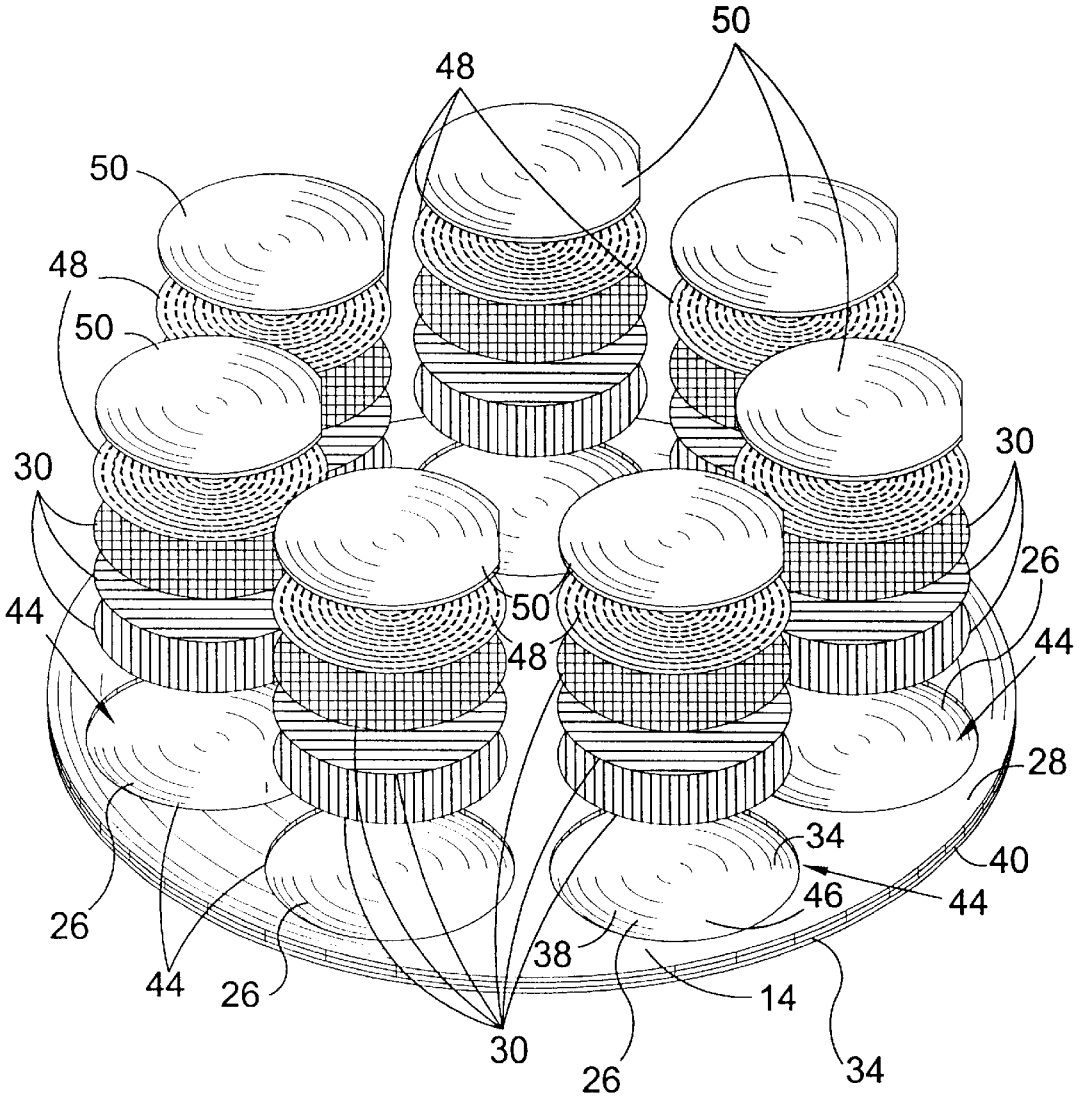
FIG. 11 is a bottom side view of the workpiece template the silicon wafer polishing holder of the present invention showing workpiece cavities in exploded form.

FIG. 11 illustrates an exploded view of the cavities 26 of an entire template 14. Each of the cavities 26 has a plurality of shim disks 30 positioned therein to adjust the thickness of the cavity 26. It is thus shown that by positioning differing amounts of shim disks 30 having varying thickness' within each cavity 26, a number of wafers 50 are able to be produced at a single time using a single template 14 whereby each wafers 50 produced can be varied to be a desired thickness. This allows for numerous wafers 50 of varying thickness' to be produced at a single time.

Figure 12:
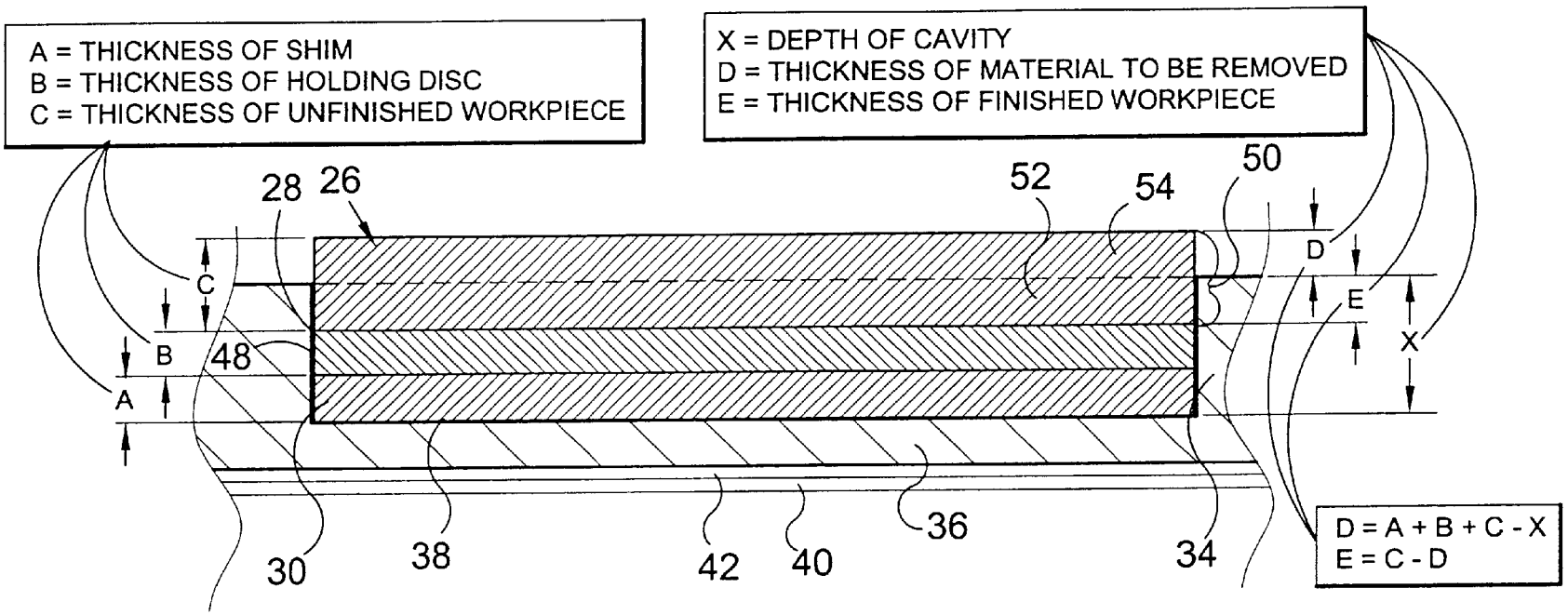
FIG. 12 is a cross-sectional view of a workpiece cavity of the silicon wafer polishing holder of the present invention.
Figure 13:
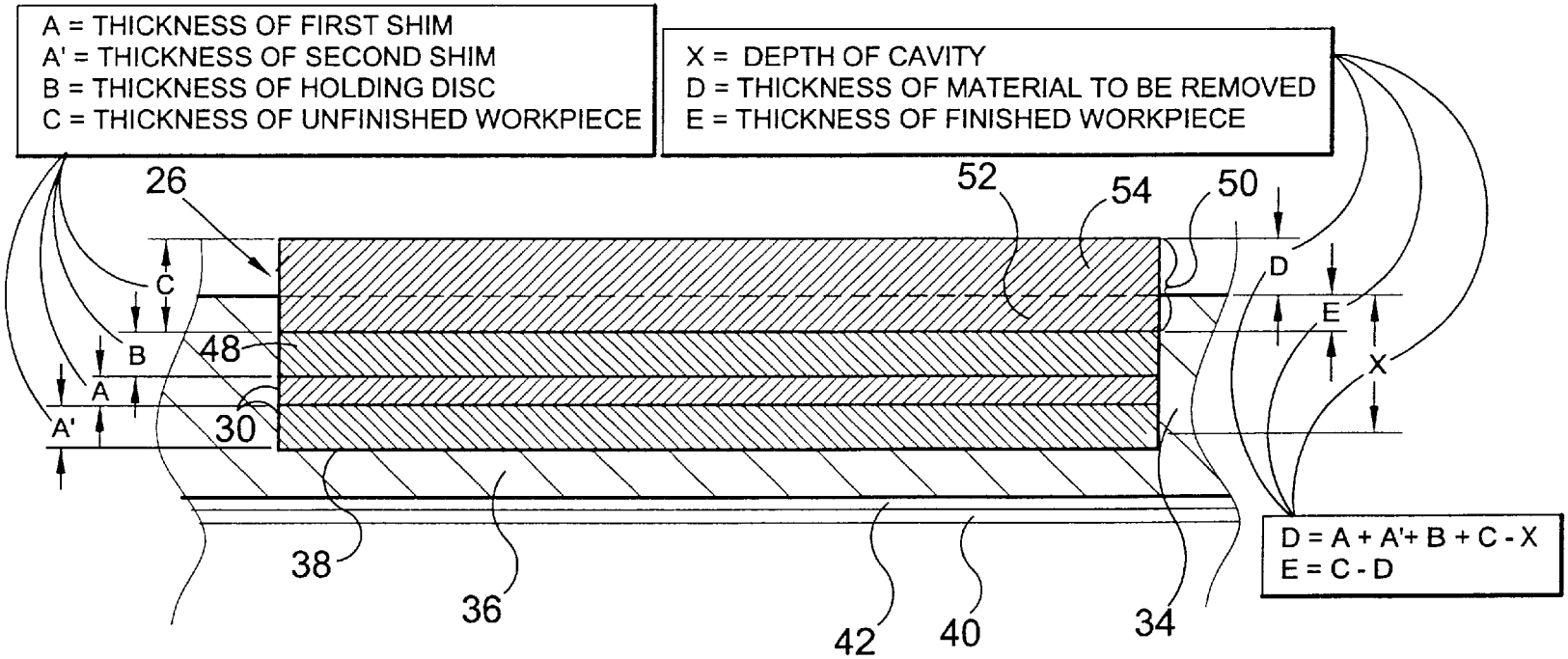
FIG. 13 is a cross-section side view of the silicon wafer polishing holder of the present invention including more than one shim within the cavity.

A cross-sectional view of a workpiece cavity 26 is shown in FIGS. 12 and 13. These figures illustrate the template 14 and elements positioned therein prior to lapping and polishing. Positioned within the cavity 26 and above the base 38 are shims 30. Positioned above the shims 30 is the holding disk 48. The wafer 50 is then positioned and held above the holding disk 48 by the suctional force created when the holding disk 48 is moistened. As can be seen from these figures, prior to lapping and polishing, the wafer 50 extends above the top of the cavity 26. The wafer 50 is thus divided into two portions, a portion remaining after lapping and polishing 52 and a portion removed by lapping and polishing 54. Thus, when the template 14 is secured to the rotating pneumatic head 12 and against the lapping and polishing surface 16, the portion 54 extending above the top of the cavity 26 will be removed. The thickness of the portion being removed 54 is dependent upon the number of shims 30 positioned within the cavity 26 and the thickness of the shims 30. In order to calculate the thickness of the wafer 50 to be remaining after lapping and polishing, "X" represents the workpiece cavity depth. While "A", "B" and "C" represent the components placed within the cavity. "A" being the shims, "B" being the holding disk and "C" being the wafer 50. "D" or 54 represents the material that will be removed from the wafer 50 by lapping and polishing. This results in a finished lapped and polished wafer 52 having a thickness of "E".

Figure 14:
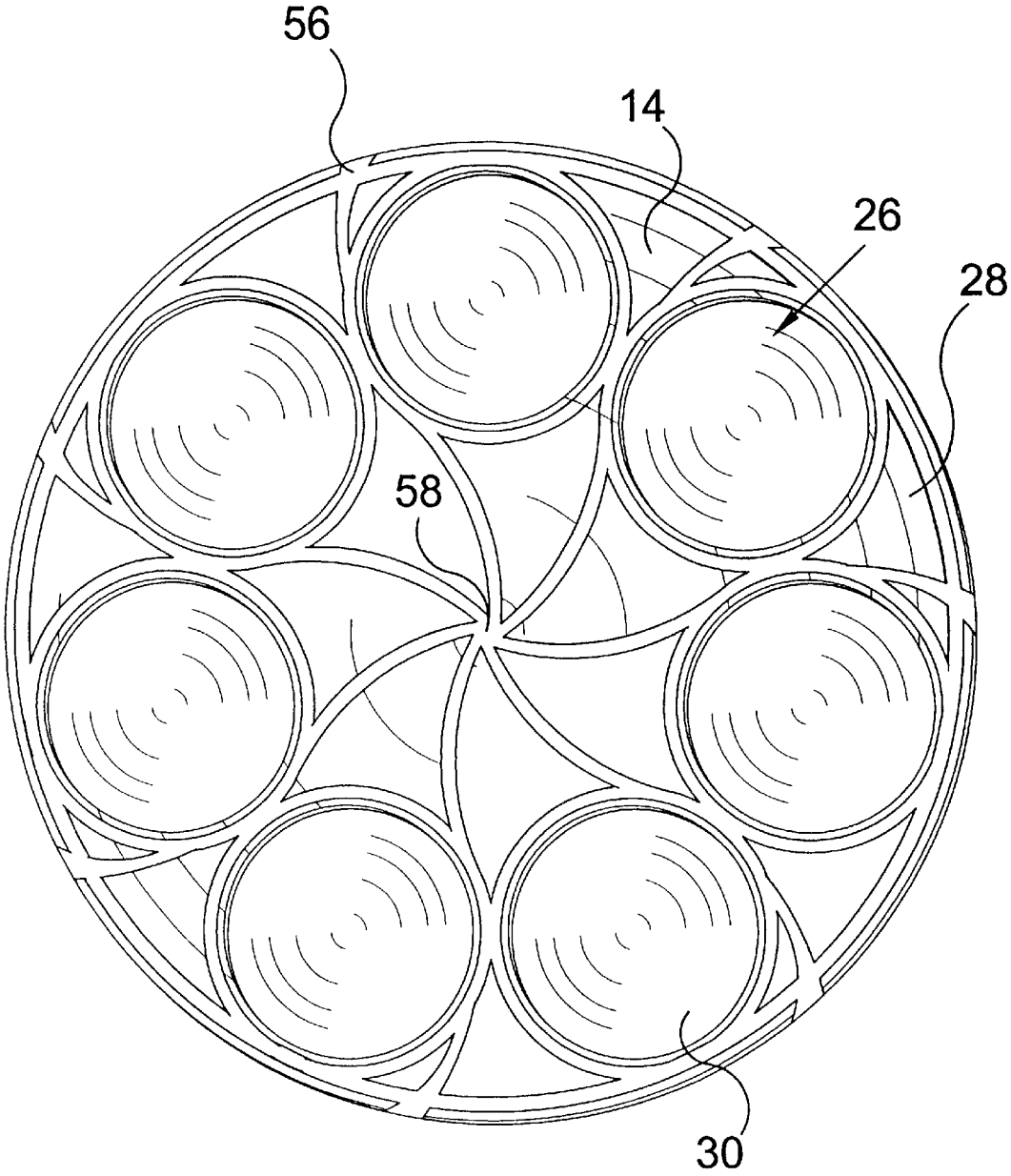
FIG. 14 is a bottom side view of the workpiece template of the silicon wafer polishing holder of the present invention.

The main plate 36 is illustrated in FIG. 14. As can be seen from this figure, the main plate 36 includes a plurality of grooves 56 extending along the top surface 28 thereof. The plurality of grooves 56 draw liquid toward a center 58 of the workpiece template 14 while in operation. The drawing of the liquid towards the center of the workpiece template 14 aids in retaining the wafers within their respective cavities 26 during lapping and polishing.

Figure 15:
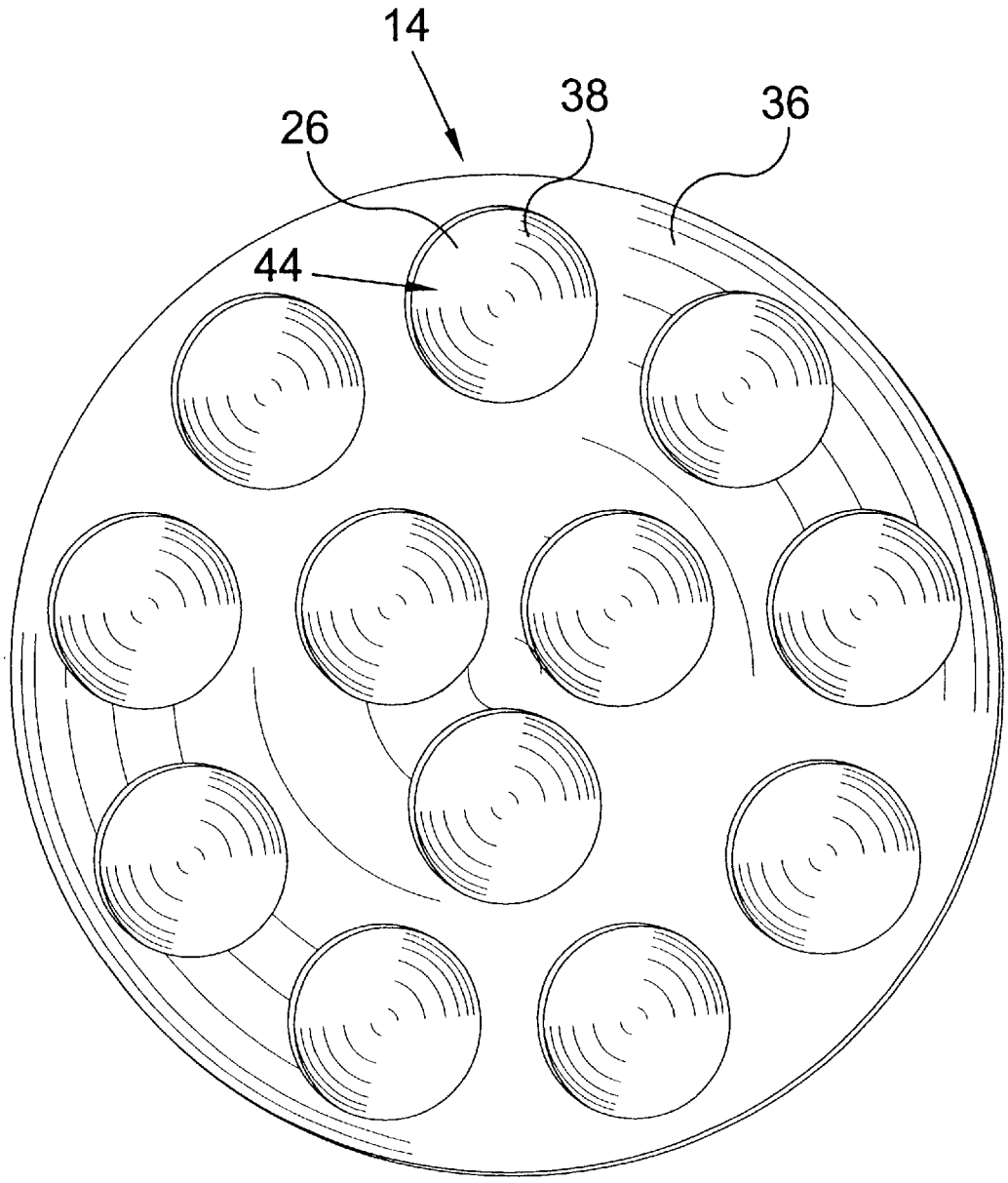
FIG. 15 is a bottom side view of an alternate workpiece template embodiment for use with the silicon wafer polishing holder of the present invention.

A workpiece template including an increased number of workpiece cavities 26 is illustrated in FIG. 15. The template 14 illustrated herein also includes an increased surface area. Increasing the number of cavities 26 enables the lapping and polishing of a greater number of wafers 50 at a single time thereby increasing production limits.

Figure 16:
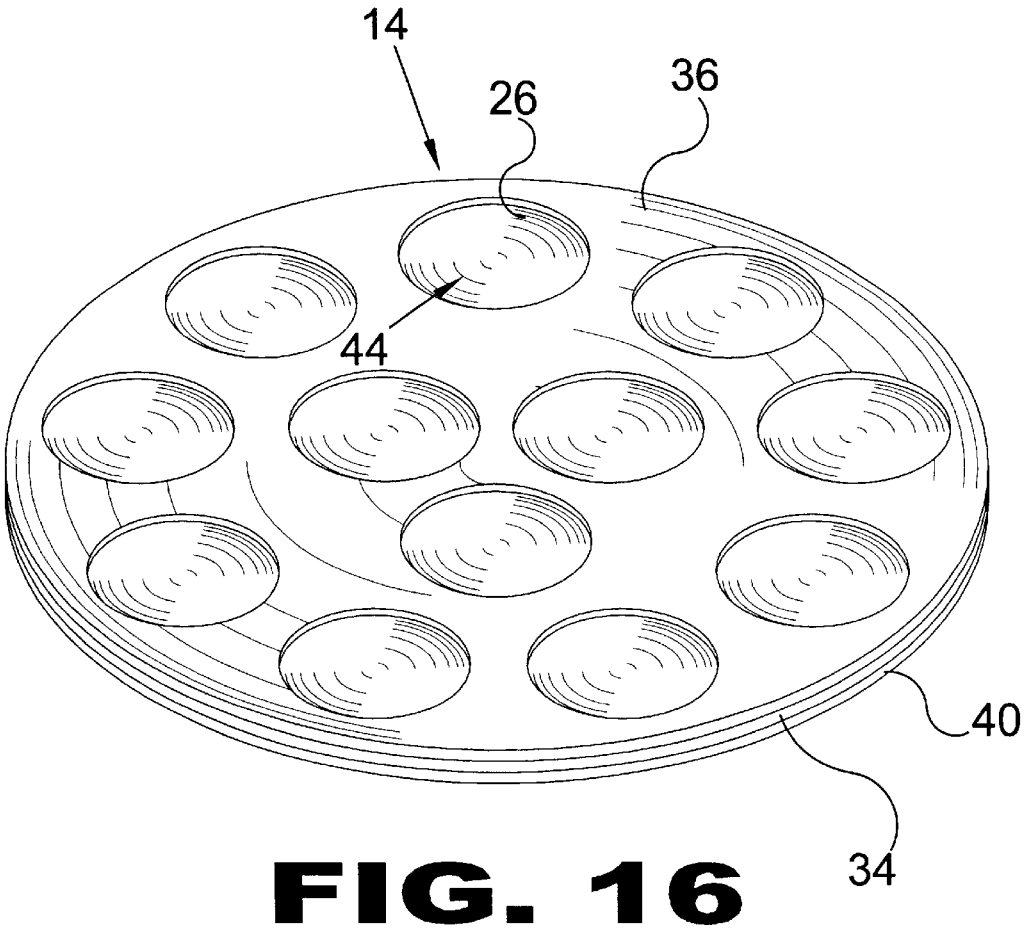
FIG. 16 is a perspective view of an alternate embodiment of the silicon wafer polishing holder of the present invention.

A perspective view of the workpiece template 14 shown in FIG. 15 is illustrated in FIG. 16. This workpiece template 14 includes an increased number of workpiece cavities 26 and increased surface area. This backing plate secured to the main disk 36 is of an increased size to match the dimensions of the workpiece template 14 for use with larger polishing machines.

Figure 17:
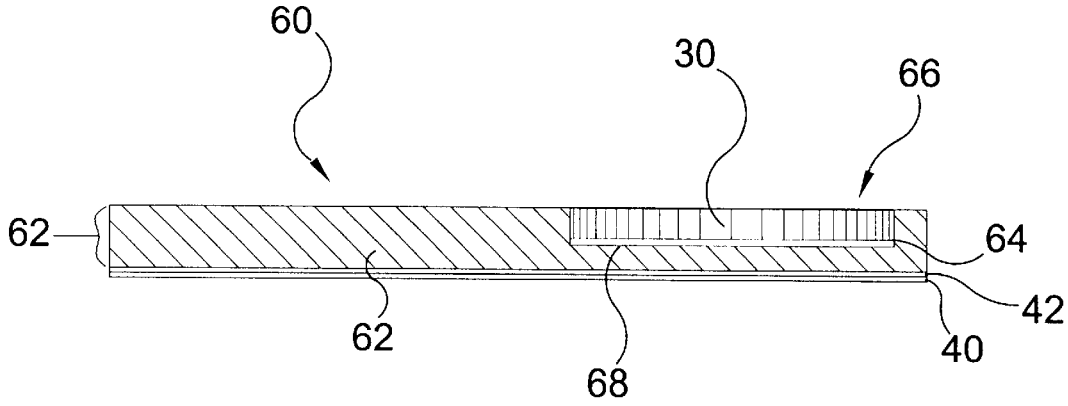
FIG. 17 is a cross sectional view of an alternate workpiece template for use in the silicon wafer polishing holder of the present invention.

A cross sectional view of an alternate embodiment for the workpiece template 60 is shown in FIG. 17. The alternate workpiece template 60 includes an alternate main plate 62. The alternate main plate 62 is preferably formed from heat and moisture resistant material such as fiberglass-epoxy laminates. However, any material able to perform the functions necessitated by the alternate main plate 62 may be used. The alternate main plate 62 includes a top side 63 having at least one recessed cavity 66 extending at least partially therethrough. An adhesive layer 64 having a circumference substantially equal to the circumference of the recessed cavity 66 is positioned within each recessed cavity 66. In order to adjust the depth of the recessed cavity 66, a shim 30 can be added thereto. The shim 30 is placed on top of the adhesive layer 64 and secured within the recessed cavity 66. The adhesive layer is described for purposes of example. However, any method of releasably securing the shim 30 to the base of the recessed cavity 68 may also be used. The alternate main plate 62 is bonded to a mylar layer 40 by the adhesive layer 42. The mylar layer 40 is bonded to a side of the main plate 62 opposite the top side.

Figure 18:
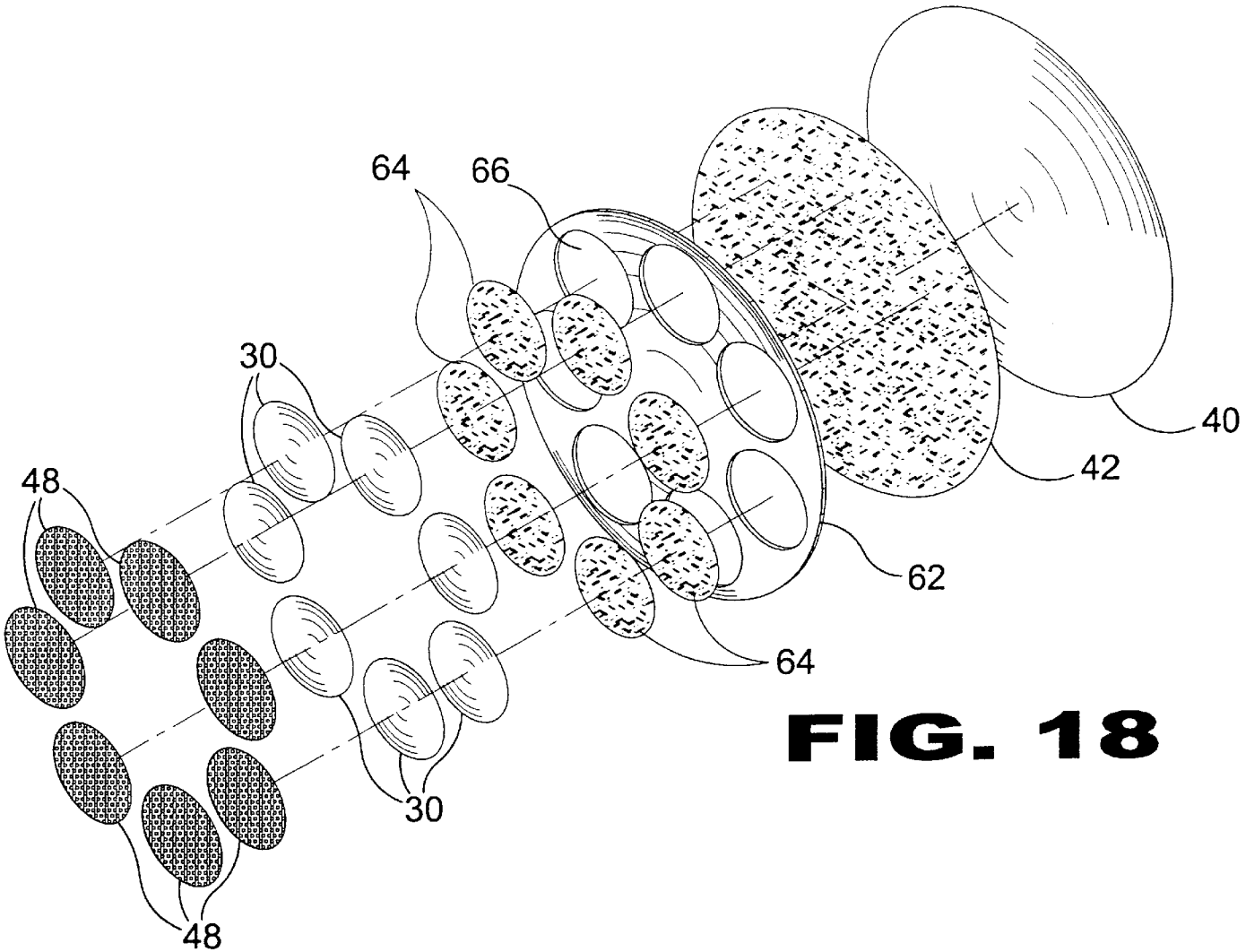
FIG. 18 is an exploded view of the alternate workpiece template for use in the silicon wafer polishing holder of the present invention.

An exploded view of the alternate workpiece template 60 is illustrated in FIG. 18. The alternate workpiece template 60 consists of the alternate main plate 62 having at least one and preferably a plurality of recessed cavities 66. The depth of each recessed cavity 66 is determined during construction of the alternate main plate 62. The cavities 66 are provided to extend at least partially through the main plate 62. The mylar layer 40 is bonded to a side of the alternate main plate 62 opposite the top side 63. The aforementioned mylar layer 40 is preferably bonded to the main plate 62 by adhesive layer 42. An adhesive layer 64 is placed within the recessed cavity 66. The adhesive layer 64 preferably has a circumference substantially equivalent to the circumference of the recessed cavity 66. A shim 30 having a desired thickness is selectively secured within the recessed cavity 66 by the adhesive layer 64. Placement of the shim 30 within the cavity 66 allows for adjustment of the depth of the recessed cavity 66 to a desired level. Alternatively the shim 30 may be releasably held in place by any material able to be placed within the cavity 66 that functions to hold the shim 30 in place. To further alter the depth of recessed cavity 66, a second shim 30 can be placed directly on top of the shim 30 adhesively bonded to the base of the recessed cavity 68. If multiple shims 30 are used to alter the depth of the recessed cavity, the shims 30 may be held together by additional adhesive layers 64 positioned therebetween. However, the shims 30 can also be stacked on top of the shim 30 bonded to the base of the recessed cavity 68. The shim 30 or combination of shims 30 can be of varying thickness. As previously discussed the shims 30 may be color coated, each color identifying a respective shim thickness. Therefore, a shim 30 or combination thereof may produce recessed cavities 66 having differing depths within a single main plate 62.

Positioned within the recessed cavity 66 atop the base of the cavity 68 is the holding disk 48. The holding disk 48 is moistened and a wafer 50 is placed atop the moistened holding disk 48. Placement of the wafer 50 atop the moistened holding disk 48 utilizes a suctional force to maintain the wafer 50 in a stationary position within the recessed cavity 66. If use of shim disks 30, as shown in FIGS. 16 and 17, is desired to adjust the depth of the cavity 66, the shim disks are positioned between the base of the cavity 68 and the holding disk 48. The placement of a shim disk as shown in FIGS. 16 and 17 decreases the depth and thus, upon lapping and polishing produces a thinner wafer 50. Using variable amounts of shim disks 30 of differing thickness allows the creation of a cavity 66 having a desired depth.

Figure 19:
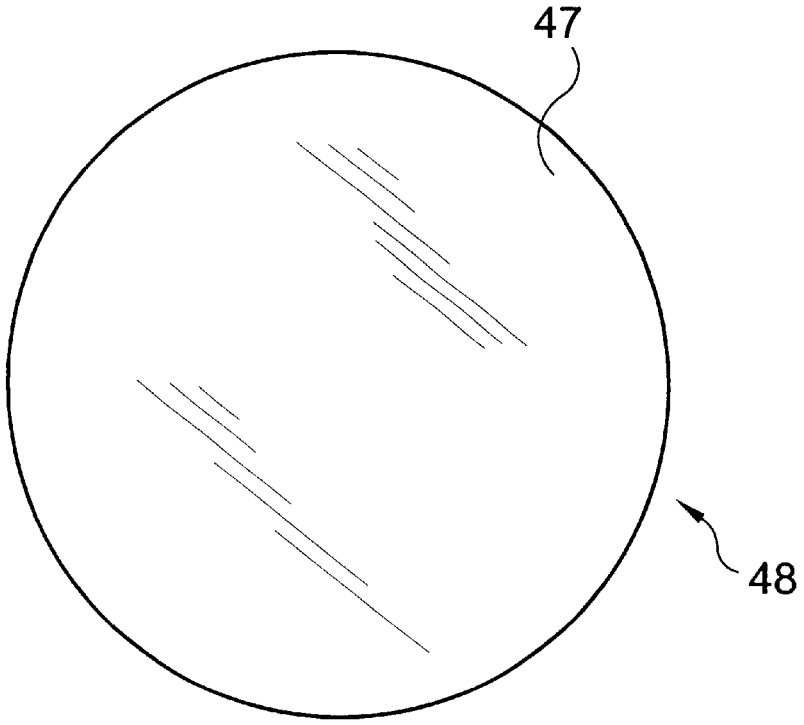
FIG. 19 is a top side view of the holding disk for use in the silicon wafer polishing holder of the present invention.
Figure 20:
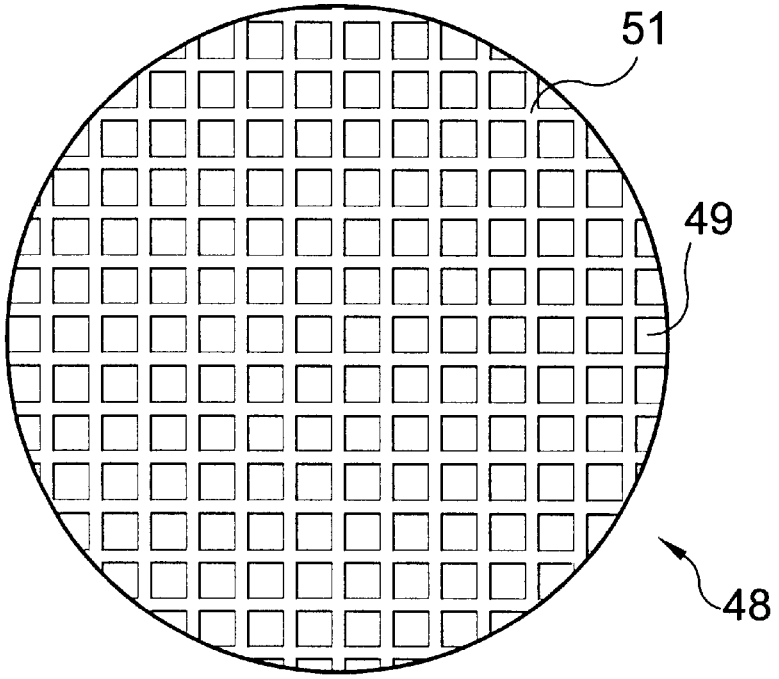
FIG. 20 is a back side view of the holding disk for use in the silicon wafer polishing holder of the present invention.
Figure 21:
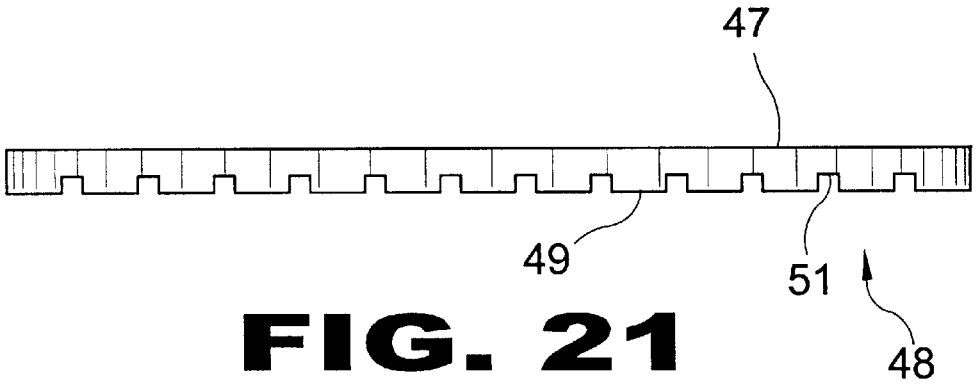
FIG. 21 is a cross sectional view of the holding disk for use in the silicon wafer polishing holder of the present invention.

The holding disk 48 is illustrated in FIGS. 19 and 20 with FIG. 19 showing a view of the top side thereof and FIG. 20 showing a view of the bottom side thereof. The bottom side 49 of the holding disk 48 includes grooves 51. The grooves 51 are preferably cut into the bottom side 49 of the holding disk 48 in a graph-like pattern. The grooves 51 are provided for increasing the suctional force created between the holding disk 48 and shims 30 positioned therebelow after the holding disk 48 is moistened and inserted into the cavity. Although the grooves are shown in the form of a graph like pattern, grooves having any desired pattern may be cut into the bottom side as long as the grooves are able to increase the suctional force created with the shims 30 positioned therebelow. The grooves 51 cut in the bottom side 49 of the holding disk 48 are better illustrated by the cross sectional view of the holding disk 48 in FIG. 21. FIG. 21 shows alternating indentations in the bottom side 49 of the holding disk 48 representative of the grooves 51.

Figure 22:
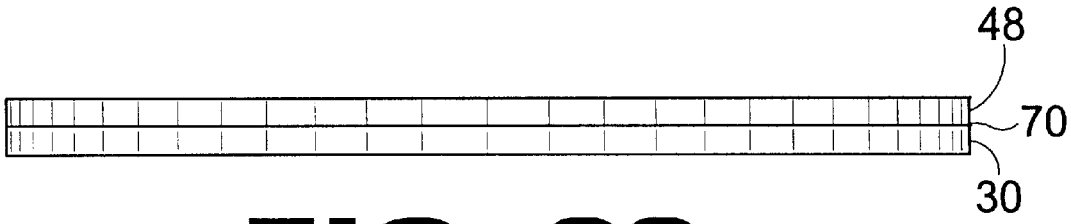
FIG. 22 is cross sectional view of the holding disk and a shim with an adhesive layer positioned therebetween for use in the silicon wafer polishing holder of the present invention.
Figure 23:
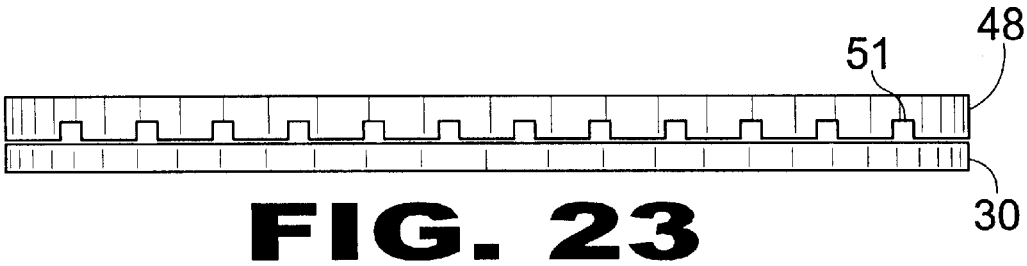
FIG. 23 is cross sectional view of the holding disk positioned atop a shim for use in the silicon wafer polishing holder of the present invention.

FIGS. 22 and 23 show the different methods by which the holding disk 48 can be releasably secured to a shim 30. FIG. 22 shows the holding disk 48 positioned atop the shim 30. Positioned between the bottom side 49 of the holding disk 48 and the top side of the shim 30 is an adhesive layer 70. When applied, the adhesive layer 70 fills the spaces created by any grooves 51 cut into the bottom side 49 of the holding disk 48 to thereby increase the force holding the holding disk 48 and the shim positioned therebelow together. Should the holding disk 48 not have grooves cut therein, the adhesive layer 70 provides the sole force securing the holding disk 48 and shim 30 positioned therebelow together. FIG. 23 shows an alternative method by which the holding disk 48 can be releasably secured to the shim 30. FIG. 23 shows the holding disk 48 positioned atop the shim 30. In this embodiment, there is no adhesive layer, rather, upon being moistened the holding disk 48 uses the grooves 51 cut in the bottom side 49 to create an increased suctional force. The increased suction force acts to releasably secure the holding disk 48 to the shim 30.

Figure 24:
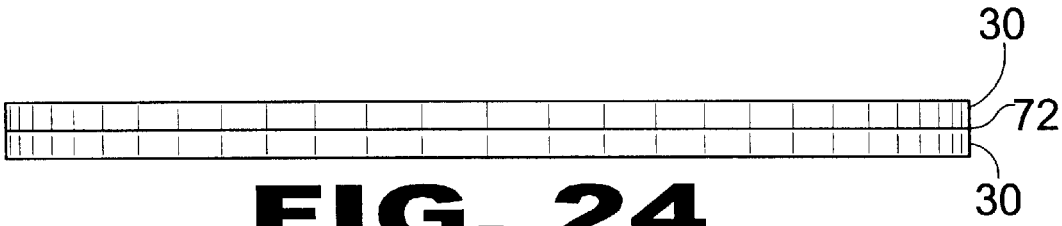
FIG. 24 is a cross sectional view of one shim positioned atop a second shim with an adhesive layer positioned therebetween for use in the silicon wafer polishing holder of the present invention.

FIG. 24 illustrates a cross sectional view of two shims 30. The shims 30 function to alter the depth of the recessed cavity 68 thereby altering the thickness of the wafer 50 being polished. Using multiple shims 30 allows for greater variance in the depths of the recessed cavity 68. FIG. 24 shows a first shim 30 positioned atop a second shim 30. These shims 30 are releasably secured together via an adhesive layer 72 positioned therebetween. Upon being secured together the newly created thicker shim 30 is ready to be received by the cavity 68.

Figure 25:
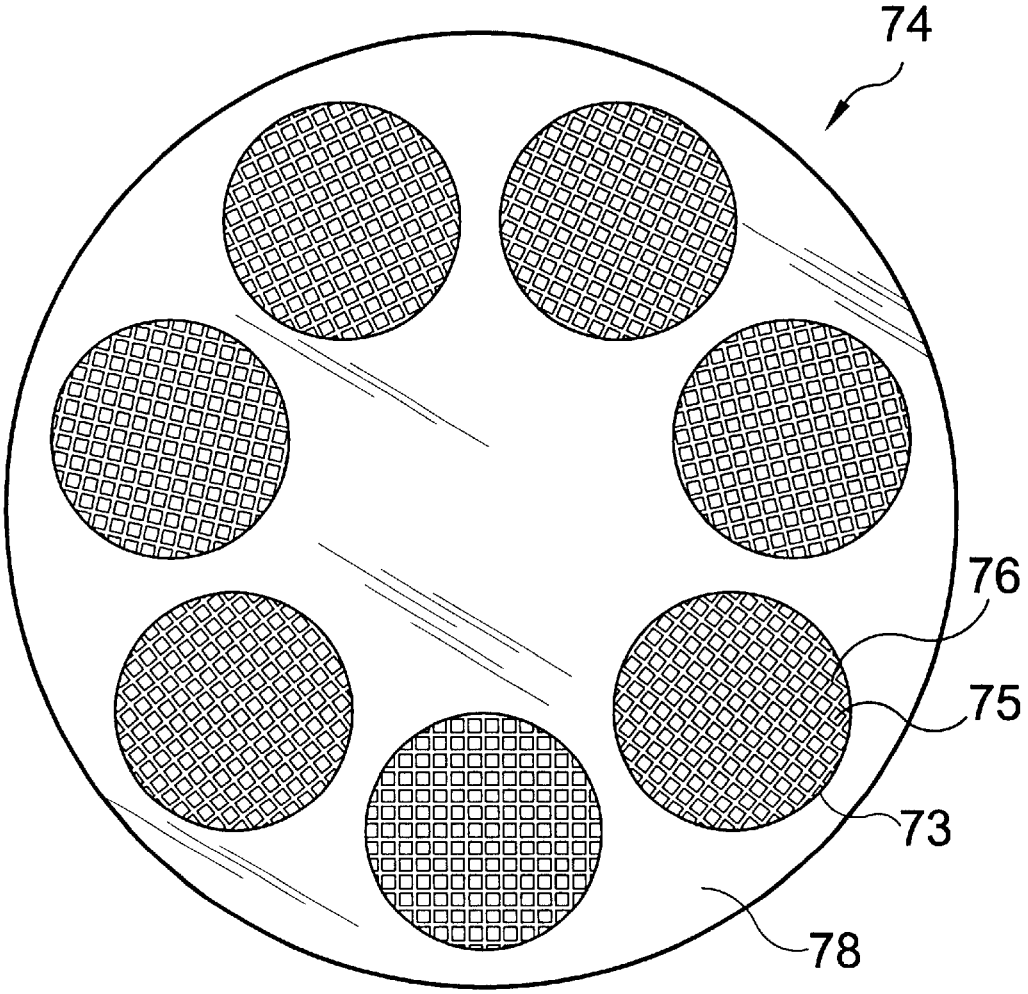
FIG. 25 is a top side view of an alternative main plate for use in the silicon wafer polishing holder of the present invention.

FIG. 25 is a top side view of a second alternate main plate 74. The main plate 74 is preferably formed from heat and moisture resistant material such as fiberglass-epoxy laminates. However, any material able to perform the functions necessitated by the main plate 74 may be used. The main plate 74 includes a top side 78 having at least one recessed cavity 73 extending at least partially therethrough. The base 75 of each at least one recessed cavity 73 having grooves 76 carved therein. The grooves 76 function to increase the suctional force created between the base of the recessed cavity 75 and a shim 30 or the holding disk 48 positioned within the cavity 75. The grooves 76 present an alternative means for releasably securing the shim 30 or the holding disk 48 to the base of the cavity 75.

The operation of the workpiece template and apparatus for lapping and polishing silicon wafers 10 will now be described with reference to the figures. In operation, the workpiece template and apparatus for lapping and polishing silicon wafers 10 is prepared for use. In preparing the workpiece template and apparatus for lapping and polishing silicon wafers 10, a backing piece 34 is secured to the bottom side 28 of the main disk 36 by an adhesive layer 46. The backing piece 34 forms a base 38 for the cavities 26. On a side of the backing piece 34 opposite the main disk 36, a mylar layer 40 is secured by a second adhesive layer 42. Alternatively a first main plate 62 that contains recessed cavities 66 can be utilized to lap and polish wafers 50, as well as a second main plate 74 that contains recessed cavities 75. A mylar layer 40 is bonded to a side opposite the top side of the main plate 62 preferably by means of an adhesive layer 42. Each cavity 26,66,73 is now prepared by placing a desired number of shims 30 of varying thickness therein. The number and thickness of the shims 30 placed within each cavity 26,66,73 determines the depth of the cavity 26 and the height to which the wafer 50, when placed within the cavity 26,66,73 will extend thereabove. After placing the shims 30 in each cavity 26,66,73 a holding disk 48 is moistened and positioned within each cavity 26,66,73 above the shims 30. The template 14 is now prepared to receive wafers 50 within respective cavities 26,66,73. The wafers 50 are positioned within a predetermined cavity 26,66,73 having a predetermined depth determined by the number and thickness of shims 30 positioned therein. A portion of the wafer 52 is seated within the cavity below the bottom side 28 thereof. A portion of the wafer 54 is positioned extending through the rim of the cavity 26,66,73 and above the bottom side 28.

The wafers are now prepared to be lapped and polished. The template is now received by the rotating pneumatic head 12 of the apparatus for lapping and polishing silicon wafers 10. When connected to the rotating pneumatic head 12, the template 14 is positioned such that the bottom side 28 and the wafers 50 are directly above the lapping and polishing surface 16. The portion of the wafer 54 is positioned extending through the rim of the cavity 26,66,73 and above the bottom side 28 is placed in contact with the lapping and polishing surface 16. Upon turning on the portion of the wafer 54 is positioned extending through the rim of the cavity 26,66,73 and above the bottom side 28, the rotating pneumatic heads 12 begin to rotate thereby rotating the template and the wafers 50 positioned within the cavities 26,66,73. Rotation of the wafers 50 causes a frictional force to develop between the portion of the wafer 54 is positioned extending through the rim of the cavity 26,66,73 and above the bottom side 28 and the lapping and polishing surface 16. The frictional force causes lapping and polishing of the wafer 50 to occur. The lapping and polishing of the wafer 50 continues until the portion of the wafer 54 is positioned extending through the rim of the cavity 26,66,73 and above the bottom side 28 is removed and the thickness of the wafer 50 equals the thickness of the portion of the wafer 54 is positioned within the cavity 26,66,73. Throughout the rotation of the rotating pneumatic heads 12, a liquid is deposited on top of the lapping and polishing surface thereby cooling the surface. As each wafer 50 within respective cavities 26,66,73 are polished to the same level, i.e. the level of the bottom surface of the main disk 36, the production of all wafers is complete simultaneously. Furthermore, the thickness of each wafer 50 is dependent on the portion of the wafer which extends into the cavity 26,66,73. Thus, wafers 50 of various sizes are able to be produced simultaneously.

From the above description it can be seen that the method and apparatus for lapping and polishing silicon wafers of the present invention is able to overcome the shortcomings of prior art devices by providing a method and apparatus for lapping and polishing silicon wafers which is able to be used repeatedly to produce a plurality of silicon wafers. The apparatus for lapping and polishing silicon wafers includes templates having a main disk substantially comprised of fiberglass-epoxy laminates and including cavities extending therein. A backing material adhesively affixed to the main disk and a layer formed of mylar or other suitable frictionless material is affixed to the backing material. A plurality of shims manufactured from a suitable material such as polyurethane may be affixed to the base of the cavities for adjusting the depth of the cavity. The shims are removably inserted into each of the plurality of cavities within the template. Another object of the present invention is to provide a method and apparatus for lapping and polishing silicon wafers having a plurality of shims of various thickness' that can be removably inserted into each of the plurality of cavities within the template whereby the template can be used to produce wafers of various and/or calculated thickness'. The method and apparatus for lapping and polishing silicon wafers is also able to reduce tapering of the wafer. Furthermore, the method and apparatus for lapping and polishing silicon wafers of the present invention is simple and easy to use and economical in cost to manufacture.

It will be understood the each of the elements described above, or two or more together may also find a useful application in other types of methods differing from the type described above.

While certain novel features of the invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A template for forming wafers of varying thickness', said template comprising:

a) a main plate including at least one cavity extending into a first side thereof;

b) at least one adhesive layer positioned within said at least one cavity, said at least one adhesive layer having a circumference substantially equivalent to a circumference of said at least one cavity;

c) at least one holding disk, said at least one holding disk positioned within said at least one cavity and releaseably secured within said at least one cavity by said at least one adhesive layer, whereby when said template is releasably secured to and rotatable with a rotating head and positioned such that said first side faces a lapping and polishing surface, a wafer received within said at least one cavity is lapped and polished upon rotation of the rotating head.

2. The template as recited in claim 1 wherein said at least one holding disk having a top side and a bottom side, said bottom side having grooves carved therein, said grooves thereby increasing the suctional force created between the base of said at least one recessed cavity and said at least one holding disk.

3. The template as recited in claim 1, further comprising a shim, said shim being selectively received within said at least one cavity between said at least one adhesive layer and said at least one holding disk for adjusting a depth of said at least one cavity and thereby adjusting an amount of a wafer to be lapped and polished.

4. The template as recited in claim 1, the main plate further comprising a plurality of cavities and said template further comprises a plurality of adhesive layers, each of said plurality of adhesive layers having a circumference substantially equivalent to a circumference of said respective one of said plurality of cavities.

5. The template as recited in claim 4, further comprising a plurality of holding disks positioned atop said plurality of adhesive layers positioned within said respective cavity.

6. The template as recited in claim 5, wherein said plurality of holding disks each having a top side and a bottom side, said bottom side having grooves carved therein for increasing the suctional force created between the base of said respective cavity and said holding disk.

7. The template as recited in claim 6, further comprising a plurality of shims, said plurality of shims being selectively received within respective ones of said plurality of cavities for adjusting a depth of said respective cavities.

8. The template as recited in claim 7, wherein said plurality of shims have varying thickness'.

9. The template as recited in claim 7, wherein said plurality of shims are color coated, each color being representative of a predetermined thickness for the shim.

10. The template as recited in claim 6, wherein said shims are adhesively fixed within respective ones of said plurality of cavities by respective ones of said plurality of adhesive layers.

11. The template as recited in claim 7, wherein said plurality of shims include a first shim and a second shim and said template further includes a shim adhesive layer positioned between said first shim and said second shim.

12. The template as recited in claim 11, wherein said heat and moisture resistant material is a fiberglass-epoxy laminate.

13. The template as recited in claim 1, wherein each of said plurality of holding disks is moistened prior to receiving a wafer in its respective cavity.

14. The template as recited in claim 1, wherein said main disk is formed of a heat and moisture resistant material.

15. The template as recited in claim 1, wherein each of said plurality of cavities extends at least partially into said main plate thereby forming said recessed cavities.

16. The template as recited in claim 1, wherein a liquid is provided atop the lapping and polishing surface upon rotation of said template.

17. The template as recited in claim 1, further comprising a layer of frictionless material is positioned on a side of the main plate opposite said first side.

18. The template as recited in claim 17, wherein said layer of frictionless material is comprised of mylar.

19. The template as recited in claim 18, further comprising an adhesive layer for securing said mylar layer to the main plate on the side opposite said first side.

20. A template for forming wafers of varying thickness', said template comprising:

a) a main plate including at least one cavity extending into a first side thereof;

b) said at least one cavity having grooves carved into the base thereof, c) at least one moistened holding disk positioned within said at least one cavity and releaseably secured therein by a suctional force, whereby when said template is releasably secured to and rotatable with a rotating head and positioned such that said first side faces a lapping and polishing surface, a wafer received within said at least one cavity is lapped and polished upon rotation of the rotating head.

21. An apparatus for lapping and polishing silicon wafters, said apparatus comprising:

a) a rotational head b) a lapping and polishing surface positioned adjacent said rotational head; and c) a template; said template comprising:

i) a main plate including at least one cavity extending into a first side thereof;

ii) at least one adhesive layer positioned within said at least one cavity, said at least one adhesive layer having a circumference substantially equivalent to a circumference of said at least one cavity;

iii) at least one holding disk, said at least one holding disk positioned within said at least one cavity and releaseably secured within said at least one cavity by said at least one adhesive layer, whereby when said template is releasably secured to and rotatable with a rotating head and positioned such that said first side faces a lapping and polishing surface, a wafer received within said at least one of cavities are lapped and polished upon rotation of the rotating head.

22. The apparatus as recited in claim 21, further comprising a shim, said shim being selectively received within said at least one cavity between said at least one adhesive layer and said at least one holding disk for adjusting a depth of said at least one cavity and thereby adjusting an amount of a wafer to be lapped and polished.

23. The apparatus as recited in claim 22, wherein each of said plurality of holding disks is moistened prior to receiving a wafer in its respective cavity.

24. The apparatus as recited in claim 21, the main plate further comprising a plurality of cavities and said template further comprises a plurality of adhesive layers, each of said plurality of adhesive layers having a circumference substantially equivalent to a circumference of said respective one of said plurality of cavities.

25. The template as recited in claim 24, further comprising a plurality of holding disks positioned atop said plurality of adhesive layers positioned within said respective cavity.

26. The apparatus as recited in claim 25, further comprising a plurality of shims, said plurality of shims being selectively received within respective ones of said plurality of cavities for adjusting a depth of said respective cavities.

27. The apparatus as recited in claim 21, wherein said plurality of shims have varying thickness'.

28. The apparatus as recited in claim 27, wherein said plurality of shims are color coated, each color representative of a predetermined thickness for the shim.

29. The apparatus as recited in claim 21, wherein said shims are adhesively fixed within respective ones of said plurality of cavities by respective ones of said plurality of adhesive layers.

30. The apparatus as recited in claim 21, wherein said main plate is formed of a heat and moisture resistant material.

31. The apparatus as recited in claim 30, wherein said heat and moisture resistant material is fiberglass-epoxy laminate.

32. The apparatus as recited in claim 21, wherein each of said plurality of cavities extends at least partially into said main plate thereby forming said recessed cavity.

33. The apparatus as recited in claim 21, further comprising a layer of frictionless material is positioned on a side of the main plate opposite said first side.

34. The apparatus as recited in claim 33, wherein said layer of frictionless material is comprised of mylar.

35. The apparatus as recited in claim 33, further comprising said adhesive layer securing the mylar layer to said main plate on the side opposite said first side.

36. A method for lapping and polishing a wafer, said method comprising the steps of:

a) forming a cavity;

b) placing an adhesive layer within the cavity;

c) moistening a holding disk;

d) positioning a moistened holding disk within a cavity of said template;

e) positioning a wafer to be lapped and polished within the cavity above the holding disk whereby the moisture within said holding disk creates a suctional force to retain the wafer within the cavity;

f) releasably securing the template to a rotating head whereby a top surface of the cavity is facing a lapping and polishing surface and the wafer is in contact with lapping and polishing surface;

g) rotating the rotating head and template to create a frictional force between the wafer and the lapping and polishing surface causing the wafer to be lapped and polished;

h) continuing rotation of said rotating head and said template until the thickness of the wafer is decreased to a desired amount substantially equal to the amount of the extending outside said cavity.

37. The method as recited in claim 36, further comprising the steps of:

a) forming a plurality of cavities;

b) placing a plurality of adhesive layers within a respective one of the plurality of cavities;

c) moistening a plurality of holding disks;

d) positioning each respective one of the plurality of holding disks within a respective one of the plurality of cavities; and e) positioning a wafer to be lapped and polished within a respective one of each of the plurality of cavities above the respective holding disk whereby the moisture within the respective holding disk creates a suctional force to retain the wafer within the cavity.

38. The method as recited in claim 37, further comprising the step of placing a plurality of shims within a respective one of the respective plurality of cavities prior to said step of positioning a respective one of the holding disks within the cavity and thereby adjusting the depth of the respective cavity.

39. The method as recited in claim 36, further comprising the step of placing at least one of the shims within a respective one of the respective plurality of cavities prior to said step of positioning a respective one of the holding disks within the cavity and thereby adjusting the depth of the respective cavity.

* * * * *